US010761441B2

(12) United States Patent
Azuma et al.

(10) Patent No.: US 10,761,441 B2
(45) Date of Patent: Sep. 1, 2020

(54) PRODUCTION METHOD FOR ELECTROPHOTOGRAPHIC PHOTOSENSITIVE MEMBER

(71) Applicant: KYOCERA Document Solutions Inc., Osaka (JP)

(72) Inventors: Jun Azuma, Osaka (JP); Tomofumi Shimizu, Osaka (JP); Kenji Kitaguchi, Osaka (JP); Kiichiro Oji, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/411,173

(22) Filed: May 14, 2019

(65) Prior Publication Data

US 2019/0354029 A1 Nov. 21, 2019

(30) Foreign Application Priority Data

May 15, 2018 (JP) ..... 2018-093830

(51) Int. Cl.
*G03G 5/05* (2006.01)
*G03G 5/06* (2006.01)

(52) U.S. Cl.
CPC ..... *G03G 5/056* (2013.01); *G03G 5/0525* (2013.01); *G03G 5/0614* (2013.01); *G03G 5/0618* (2013.01)

(58) Field of Classification Search
CPC ... G03G 5/14756; G03G 5/056; G03G 5/0564
See application file for complete search history.

(56) References Cited

U.S. PATENT DOCUMENTS

2001/0049067 A1 12/2001 Mitsumori et al.
2004/0101771 A1* 5/2004 Azuma ..... G03G 5/05 430/58.85

(Continued)

FOREIGN PATENT DOCUMENTS

JP 05-019499 * 1/1993 ..... G03G 5/05
JP 2002268256 A 9/2002
JP 2007-169617 A 7/2007

OTHER PUBLICATIONS

Translation of JP 05-19499.*

(Continued)

*Primary Examiner* — Peter L Vajda
(74) *Attorney, Agent, or Firm* — Studebaker & Brackett PC

(57) ABSTRACT

A method for producing an electrophotographic photosensitive member includes an electrically conductive substrate and a photosensitive layer. The method includes applying an application liquid for photosensitive layer formation containing a solvent, a binder resin, and a hole transport material directly or indirectly onto the electrically conductive substrate, and removing a portion of the solvent, to form the photosensitive layer. The solvent contains a first solvent that is an alcohol having a carbon number of at least 1 and no greater than 3, and a second solvent other than the first solvent. The binder resin includes a polyarylate resin that is a polymerization product of monomers including a first monomer represented by general formula (1) and a second monomer represented by general formula (2), (Continued)

(1)

(2)

11 Claims, 2 Drawing Sheets

(56) References Cited

U.S. PATENT DOCUMENTS

| | | | | |
|---|---|---|---|---|
| 2010/0290808 | A1* | 11/2010 | Itami | C07C 211/54<br>399/159 |
| 2017/0003608 | A1* | 1/2017 | Azuma | G03G 5/056 |
| 2017/0242352 | A1* | 8/2017 | Ogaki | C08G 63/189 |

OTHER PUBLICATIONS

The extended European search report issued by the European Patent Office dated Aug. 19, 2019, which corresponds to European Patent Application No. 19174585.0-1107.

* cited by examiner

PRODUCTION METHOD FOR ELECTROPHOTOGRAPHIC PHOTOSENSITIVE MEMBER

INCORPORATION BY REFERENCE

The present application claims priority under 35 U.S.C. § 119 to Japanese Patent Application No. 2018-093830, filed on May 15, 2018. The contents of this application are incorporated herein by reference in their entirety.

BACKGROUND

The present disclosure relates to production methods for electrophotographic photosensitive members.

Electrophotographic photosensitive members are used as image bearing members in electrographic image forming apparatuses (e.g., printers or multifunction peripherals). An electrophotographic photosensitive member includes a photosensitive layer. Examples of electrophotographic photosensitive members include monolayer electrophotographic photosensitive members and multilayer electrophotographic photosensitive members. A monolayer electrophotographic photosensitive member includes a photosensitive layer that is a single layer having the function of generating electric charge and the function of transporting charge. A multilayer electrophotographic photosensitive member includes a photosensitive layer that includes a charge generating layer having the function of generating charge and a charge transport layer having the function of transporting charge.

As an example of a binder resin that is used in electrophotographic photosensitive members, a polyarylate resin has been studied that is obtained by an interfacial polycondensation reaction of an aromatic dicarboxylic acid component with an aromatic dihydric alcohol component, and in which the mass ratio of a carboxylic acid halide represented by the following general formula (A), that is located at an end of polyarylate resin, is 10 ppm or less. In the general formula (A), PAR represents a polyarylate chain, and X represents a halogen atom.

(A)

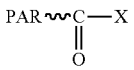

SUMMARY

A method for producing an electrophotographic photosensitive member including an electrically conductive substrate and a photosensitive layer, according to the present disclosure, includes applying an application liquid for photosensitive layer formation containing a solvent, a binder resin, and a hole transport material directly or indirectly onto the electrically conductive substrate, and removing a portion of the solvent, to form the photosensitive layer. The solvent contains a first solvent that is an alcohol having a carbon number of at least 1 and no greater than 3, and a second solvent other than the first solvent. The binder resin includes a polyarylate resin that is a polymerization product of monomers including a first monomer represented by the following general formula (1) and a second monomer represented by the following general formula (2).

(1)

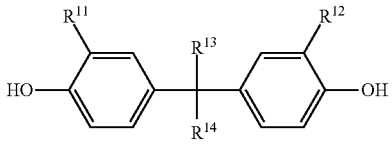

(2)

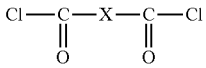

In the general formula (1), $R^{11}$ and $R^{12}$ each independently represent a hydrogen atom or an alkyl group having a carbon number of at least 1 and no greater than 4. $R^{13}$ and $R^{14}$ each independently represent a hydrogen atom, an alkyl group having a carbon number of at least 1 and no greater than 4, or a phenyl group, or $R^{13}$ and $R^{14}$ taken together represent a divalent group represented by the following general formula (Y). In the general formula (2), X represents a divalent group represented by chemical formula (X1), (X2), (X3), (X4), (X5), or (X6).

(Y)

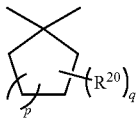

In the general formula (Y), $R^{20}$ represents a monovalent substituent. p represents an integer of at least 1 and no greater than 6. q represents an integer of at least 0 and no greater than 5.

(X1)

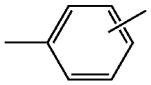

(X2)

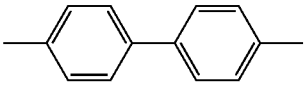

(X3)

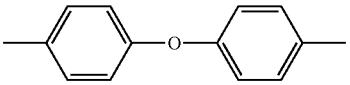

(X4)

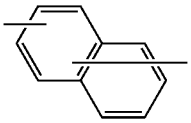

(X5)

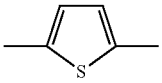

(X6)

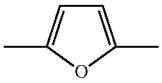

DETAILED DESCRIPTION

Figure 1:
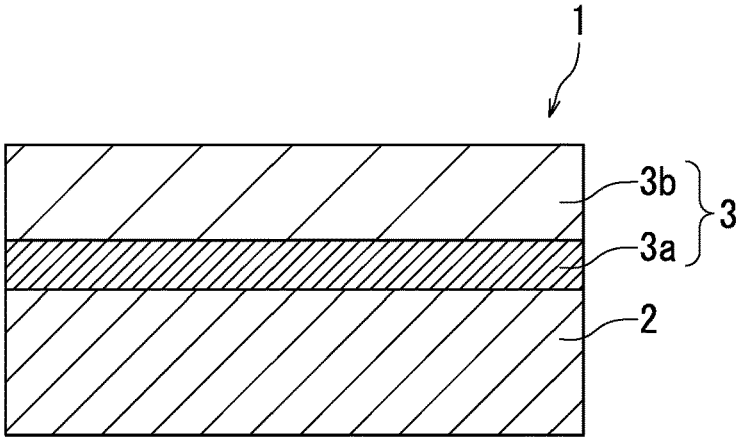
FIG. 1 is a partial cross-sectional view showing an example photosensitive member obtained by an electrophotographic photosensitive member production method according to a first embodiment of the present disclosure.

Embodiments of the present disclosure will now be described in detail. The present disclosure is not intended to be limited to the embodiments set forth herein, but on the contrary, it is intended to cover such alternatives, modifications, and equivalents as can be reasonably included within the spirit and scope of the present disclosure. Note that the same or like parts may not be redundantly described, but this is not intended to limit the subject matter of the present disclosure. As used herein, the word "-based" may be added to the end of the name of a compound to form a collective word that comprehensively indicates that compound and derivatives thereof.

In the description that follows, an alkyl group having a carbon number of at least 1 and no greater than 8, an alkyl group having a carbon number of at least 1 and no greater than 6, an alkyl group having a carbon number of at least 1 and no greater than 4, an alkoxy group having a carbon number of at least 1 and no greater than 8, an alkoxy group a carbon number of at least 1 and no greater than 6, an alkoxy group having a carbon number of at least 1 and no greater than 4, an aryl group having a carbon number of at least 6 and no greater than 14, a cycloalkane having a carbon number of at least 5 and no greater than 7, and a halogen atom each have the following meaning.

An alkyl group having a carbon number of at least 1 and no greater than 8, an alkyl group having a carbon number of at least 1 and no greater than 6, and an alkyl group having a carbon number of at least 1 and no greater than 4 are each a straight-chain or branched, unsubstituted group. Examples of an alkyl group having a carbon number of at least 1 and no greater than 8 include methyl, ethyl, propyl, isopropyl, n-butyl, s-butyl, t-butyl, pentyl, isopentyl, neopentyl, hexyl, heptyl, and octyl. Examples of an alkyl group having a carbon number of at least 1 and no greater than 6 and an alkyl group having a carbon number of at least 1 and no greater than 4 include those having a carbon number of at least 1 and no greater than 6 or those having a carbon number of at least 1 and no greater than 4 of the above examples of an alkyl group having a carbon number of at least 1 and no greater than 8.

An alkoxy group having a carbon number of at least 1 and no greater than 8, an alkoxy group having a carbon number of at least 1 and no greater than 6, and an alkoxy group having a carbon number of at least 1 and no greater than 4 are a straight-chain or branched, unsubstituted group. Examples of an alkoxy group having a carbon number of at least 1 and no greater than 8 include methoxy, ethoxy, n-propoxy, isopropoxy, n-butoxy, s-butoxy, t-butoxy, pentyloxy, isopentyloxy, neopentyloxy, and hexyloxy. Examples of an alkoxy group having a carbon number of at least 1 and no greater than 6 and an alkoxy group having a carbon number of at least 1 and no greater than 4 include those having a carbon number of at least 1 and no greater than 6 and those having a carbon number of at least 1 and no greater than 4 of the above examples of an alkoxy group having a carbon number of at least 1 and no greater than 8.

An aryl group having a carbon number of at least 6 and no greater than 14 is unsubstituted. Examples of an aryl group having a carbon number of at least 6 and no greater than 14 include unsubstituted aromatic monocyclic hydrocarbon groups having a carbon number of at least 6 and no greater than 14, unsubstituted aromatic fused bicyclic hydrocarbon groups having a carbon number of at least 6 and no greater than 14, and unsubstituted aromatic fused tricyclic hydrocarbon groups having a carbon number of at least 6 and no greater than 14. More specific examples of an aryl group having a carbon number of at least 6 and no greater than 14 include phenyl, naphthyl, anthryl, and phenanthryl.

A cycloalkane having a carbon number of at least 5 and no greater than 7 is unsubstituted. Examples of a cycloalkane having a carbon number of at least 5 and no greater than 7 include cyclopentane, cyclohexane, and cycloheptane.

Examples of a halogen atom include fluorine, chlorine, bromine, and iodine.

As used herein, the phase "optionally substituted with an alkyl group having a carbon number of at least 1 and no greater than 8" with respect to a functional group means that all or a portion of the hydrogen atoms of the functional group may be substituted with an alkyl group having a carbon number of at least 1 and no greater than 8.

First Embodiment: Production Method for Electrophotographic Photosensitive Member A production method for an electrophotographic photosensitive member (also hereinafter referred to as a "photosensitive member") according to a first embodiment of the present disclosure is a method for producing a photosensitive member including an electrically conductive substrate and a photosensitive layer, the method including applying an application liquid for photosensitive layer formation containing a solvent, a binder resin, and a hole transport material directly or indirectly onto the electrically conductive substrate, and removing a portion of the solvent, to form the photosensitive layer (also hereinafter referred to as a "photosensitive layer formation step"). The solvent contains a first solvent and a second solvent described below. The binder resin includes a polyarylate resin described below. As the photosensitive member production method, a production method for a photosensitive member including an electrically conductive substrate, and a charge generating layer and a charge transport layer as a photosensitive layer (also hereinafter referred to as a "multilayer photosensitive member"), and a production method for a photosensitive member including an electrically conductive substrate and a single photosensitive layer (also hereinafter referred to as a "monolayer photosensitive member"), will now be described in that order.

[Production Method for Multilayer Photosensitive Member]

Figure 2:
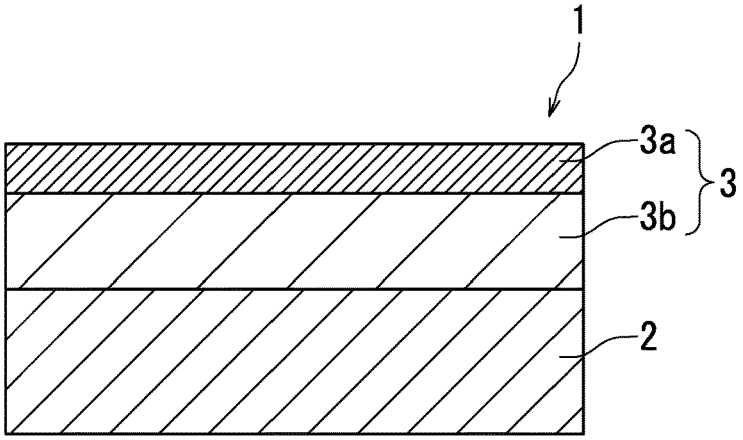
FIG. 2 is a partial cross-sectional view showing an example photosensitive member obtained by an electrophotographic photosensitive member production method according to the first embodiment of the present disclosure.
Figure 3:
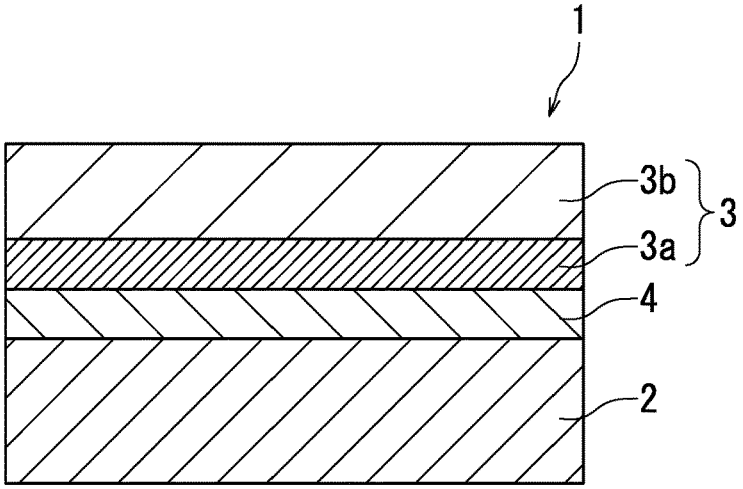
FIG. 3 is a partial cross-sectional view showing an example photosensitive member obtained by an electrophotographic photosensitive member production method according to the first embodiment of the present disclosure.

Firstly, a multilayer photosensitive member produced by the multilayer photosensitive member production method will be described. FIGS. 1-3 are each a partial cross-sectional view showing an example photosensitive member 1 that is a multilayer photosensitive member.

As shown in FIG. 1, the multilayer photosensitive member 1 includes, for example, an electrically conductive substrate 2 and a photosensitive layer 3. The photosensitive layer 3 includes a charge generating layer 3*a* and a charge transport layer 3*b*. Thus, the multilayer photosensitive member 1 includes the charge generating layer 3*a* and the charge transport layer 3*b* as the photosensitive layer 3.

As shown in FIG. 1, in order to improve the abrasion resistance of the multilayer photosensitive member 1, it is preferable that the charge generating layer 3*a* be provided on the electrically conductive substrate 2, and the charge transport layer 3*b* be provided on the charge generating layer 3*a*. Alternatively, as shown in FIG. 2, in the multilayer photosensitive member 1, the charge transport layer 3*b* may be provided on the electrically conductive substrate 2, and the charge generating layer 3*a* may be provided on the charge transport layer 3*b*.

As shown in FIG. 3, the multilayer photosensitive member 1 may include an electrically conductive substrate 2, a photosensitive layer 3, and a middle layer 4 (undercoat layer). The middle layer 4 is provided between the electrically conductive substrate 2 and the photosensitive layer 3. As shown in FIGS. 1 and 2, the photosensitive layer 3 may be provided directly on the electrically conductive substrate 2. Alternatively, as shown in FIG. 3, the photosensitive layer 3 may be provided on the electrically conductive substrate 2 with the middle layer 4 interposed therebetween. In FIGS. 1-3, a protective layer is not provided on the photosensitive layer 3, i.e. the photosensitive layer 3 is the outermost surface layer of the photosensitive member 1. Alternatively, a protective layer may be provided on the photosensitive layer 3.

The thickness of the charge generating layer 3*a* is not particularly limited, and may be preferably at least 0.01 μm and no greater than 5 μm, more preferably at least 0.1 μm and no greater than 3 μm. The thickness of the charge transport layer 3*b* is not particularly limited, and may be preferably at least 2 μm and no greater than 100 μm, more preferably at least 5 μm and no greater than 50 μm. In the foregoing, the multilayer photosensitive member 1 has been outlined with reference to FIGS. 1-3. Each element (the electrically conductive substrate, the photosensitive layer, and the middle layer) of the multilayer photosensitive member will now be described in detail.

(Electrically Conductive Substrate)

The electrically conductive substrate may be any suitable electrically conductive substrate that can be used as the electrically conductive substrate of the photosensitive member. At least a surface portion of the electrically conductive substrate may be formed of an electrically conductive material. An example of the electrically conductive substrate is one that is formed of an electrically conductive material. Another example of the electrically conductive substrate is one that is covered with an electrically conductive material. Examples of electrically conductive materials include aluminum, iron, copper, tin, platinum, silver, vanadium, molybdenum, chromium, cadmium, titanium, nickel, palladium, indium, stainless steel, and brass. These electrically conductive materials may be used alone or in combination (e.g., in the form of an alloy). Of these electrically conductive materials, aluminum and aluminum alloys are preferable because charge is satisfactorily moved from the photosensitive layer to the electrically conductive substrate.

The shape of the electrically conductive substrate is suitably designed for the structure of an image forming apparatus. Examples of the shape of the electrically conductive substrate include sheet-shape and drum-shape. The thickness of the electrically conductive substrate is suitably selected, depending on the shape of the electrically conductive substrate.

(Photosensitive Layer)

The photosensitive layer includes a charge transport layer and a charge generating layer. The charge transport layer contains an alcohol having a carbon number of at least 1 and no greater than 3 (also hereinafter referred to as a "lower alcohol"), a hole transport material, and a binder resin. The charge transport layer may further contain an additive. The charge generating layer contains a charge generating material, and may further contain a binder resin or an additive. Each component of the photosensitive layer will be described in detail below.

(Middle Layer)

The middle layer (undercoat layer) contains, for example, inorganic particles, and a resin used in the middle layer (middle layer resin). The presence of the middle layer may allow for smooth flow of a current generated during exposure of the photosensitive member while maintaining insulation to the extent that the occurrence of leakage can be inhibited, thereby inhibiting an increase in resistance.

Examples of the inorganic particles include particles of a metal (e.g., aluminum, iron, or copper), particles of a metal oxide (e.g., titanium oxide, alumina, zirconium oxide, tin oxide, or zinc oxide), and particles of a non-metal oxide (e.g., silica). These inorganic particles may be used alone or in combination.

Examples of the middle layer resin and additive used in the middle layer include binder resins and additives similar to those used in the photosensitive layer, which are exemplified below. Note that in order to satisfactorily form the middle layer and the photosensitive layer, the middle layer resin is preferably different from the binder resin contained in the photosensitive layer.

(Photosensitive Layer Formation Step)

Each step of a method for producing the multilayer photosensitive member will now be described. The multilayer photosensitive member production method includes a photosensitive layer formation step having a charge transport layer formation step and a charge generating layer formation step.

In the charge transport layer formation step, an application liquid for photosensitive layer formation (also referred to as an "application liquid for charge transport layer formation") containing a solvent, a binder resin, and a hole transport material is applied directly or indirectly onto an electrically conductive substrate, and a portion of the solvent is removed, to form a charge transport layer.

In the charge generating layer formation step, an application liquid for photosensitive layer formation (also hereinafter referred to as an "charge generating layer application liquid for charge generating layer formation") containing a solvent and a charge generating material is applied directly or indirectly onto the electrically conductive substrate, and at least a portion of the solvent is removed, to form a charge generating layer. Note that the multilayer photosensitive member production method may optionally further include a step of forming a middle layer. The middle layer may be formed using any suitable known technique.

The charge generating layer application liquid for charge generating layer formation may further contain a binder resin. The application liquid for charge transport layer formation and the charge generating layer application liquid for charge generating layer formation may further contain an additive so that the formed photosensitive member has desired characteristics. The application liquid for charge transport layer formation and the charge generating layer application liquid for charge generating layer formation may also contain, for example, a surfactant or a leveling agent in order to improve the dispersibility of each component or the surface smoothness of each layer.

The application liquid for photosensitive layer formation is formulated by mixing the components together and dispersing the components in the solvent. For the mixing or dispersing, for example, a bead mill, roller mill, ball mill, attritor, paint shaker, or ultrasonic disperser can be used.

The application liquid for photosensitive layer formation may be applied using any suitable technique capable of uniformly applying the liquid. Examples of such an application technique include dip coating, spray coating, spin coating, and bar coating.

A portion of the solvent contained in the application liquid for photosensitive layer formation may be removed using any suitable technique capable of evaporating the solvent. Examples of such a technique include heating, depressurization, or a combination of heating and depressurization. More specifically, for example, a heat treatment (hot air drying) may be performed using a high temperature dryer or a low pressure dryer. The heat treatment is, for example, performed under condition that the temperature is at least 40° C. and no greater than 150° C. and the duration is at least 3 min and no greater than 120 min. Each component of the application liquid for photosensitive layer formation will now be described.

(Solvent)

The solvent contained in the application liquid for charge transport layer formation contains a first solvent that is a lower alcohol, and a second solvent other than the first solvent.

Examples of the lower alcohol include methanol, ethanol, 1-propanol, and 2-propanol. In order to further improve the charging characteristics of the photosensitive member, the lower alcohol is preferably methanol or 2-propanol, more preferably methanol.

The content proportion of the first solvent to the solvent of the application liquid for charge transport layer formation (100×the mass of the first solvent/the total mass of the first solvent and the second solvent) is preferably at least 0.5 mass % and no greater than 5.0 mass %, more preferably at least 1.0 mass % and no greater than 3.0 mass %. In the case where the mass ratio of the first solvent is 0.5 mass % or more, the formed photosensitive member can have further improved charging characteristics. In the case where the mass ratio of the first solvent is 5.0 mass % or less, the binder resin can be easily dissolved in the application liquid for charge transport layer formation, and therefore, the photosensitive layer can be easily formed.

The second solvent may be any suitable solvent in which the binder resin and the hole transport material can be dissolved or dispersed. Examples of the second solvent include aliphatic hydrocarbons (more specifically, n-hexane, octane, cyclohexane, etc.), aromatic hydrocarbons (more specifically, benzene, toluene, xylene, etc.), halogenated hydrocarbons (more specifically, methylene chloride (dichloromethane), chloroform (trichloromethane), dichloroethane, tetrachloride carbon, chlorobenzene, etc.), ethers (more specifically, 1,3-dioxolane, dimethyl ether, diethyl ether, tetrahydrofuran, ethylene glycol dimethyl ether, diethylene glycol dimethyl ether, etc.), ketones (more specifically, acetone, methyl ethyl ketone, cyclohexanone, etc.), esters (more specifically, ethyl acetate, methyl acetate, etc.), dimethyl formaldehyde, dimethyl formamide, and dimethyl sulfoxide. These solvents may be used alone or in combination (e.g., two types of solvents may be combined). The second solvent is preferably a halogenated hydrocarbon or an ether, more preferably methylene chloride, chloroform, tetrahydrofuran, or 1,3-dioxolane. The second solvent may also preferably be a mixed solvent of toluene and a halogenated hydrocarbon or an ether.

Examples of the solvent contained in the charge generating layer application liquid for charge generating layer formation include solvents similar to those that are exemplified above as the solvent contained in the application liquid for charge transport layer formation. Note that the solvent contained in the application liquid for charge transport layer formation is preferably different from the solvent contained in the charge generating layer application liquid for charge genaration layer formation. This is because it is preferable that when the application liquid for charge transport layer formation is applied onto the electric charge generating layer, the electric charge generating layer should not be dissolved in the solvent of the application liquid for charge transport layer formation.

(Binder Resin)

The binder resin contained in the application liquid for charge transport layer formation contains a polyarylate resin (also hereinafter referred to as a "polyarylate resin (PA1)") that is a polymerization product of monomers including a first monomer represented by the following general formula (1) (also hereinafter referred to as a "monomer (1)") and a second monomer represented by the following general formula (2) (also hereinafter referred to as a "monomer (2)"). Thus, the polyarylate resin (PA1) has a repeating unit derived from the monomer (1) and a repeating unit derived from the monomer (2).

(1)

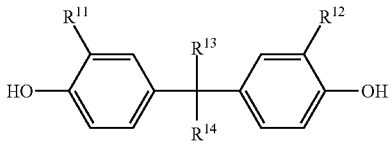

(2)

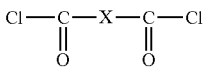

In the general formula (1), $R^{11}$ and $R^{12}$ each independently represent a hydrogen atom or an alkyl group having a carbon number of at least 1 and no greater than 4. $R^{13}$ and $R^{14}$ each independently represent a hydrogen atom, an alkyl group having a carbon number of at least 1 and no greater than 4, or a phenyl group, or $R^{13}$ and $R^{14}$ taken together represent a divalent group represented by the following general formula (Y) below. In general formula (2), X represents a divalent group represented by the following chemical formula (X1), (X2), (X3), (X4), (X5), or (X6).

(Y)

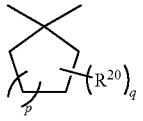

In the general formula (Y), $R^{20}$ represents a monovalent substituent. p represents an integer of at least 1 and no greater than 6. q represents an integer of at least 0 and no greater than 5.

(X1)

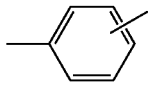

(X2)

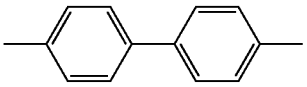

(X3)

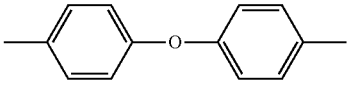

(X4)

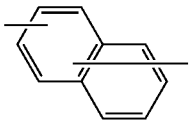

(X5)

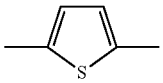

(X6)

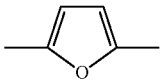

In the photosensitive member production method according to the first embodiment of the present disclosure, a photosensitive layer (the charge transport layer in the multilayer photosensitive member production method) is formed using an application liquid for photosensitive layer formation (the application liquid for charge transport layer formation in the multilayer photosensitive member production method) containing a solvent containing a lower alcohol, and a binder resin containing the polyarylate resin (PA1), and therefore, the formed photosensitive member can have improved charging characteristics and abrasion resistance. Here, the polyarylate resin (PA1), when used as the binder resin of the photosensitive layer, can improve the abrasion resistance of the photosensitive member, and tends to decrease the charging characteristics. This may be because in the polyarylate resin (PA1), an aromatic dicarboxylic acid dichloride (the monomer (2)) used as a raw material remains unreacted. Therefore, the aromatic dicarboxylic acid dichloride is unavoidably contained in the photosensitive layer containing the polyarylate resin (PA1). The aromatic dicarboxylic acid dichloride contains a chlorine atom, which has a great electronegativity, and therefore, may reduce the charging characteristics of the photosensitive member. In contrast to this, in the photosensitive member production method according to the first embodiment of the present disclosure, the application liquid for photosensitive layer formation contains a lower alcohol. The lower alcohol reacts with the aromatic dicarboxylic acid dichloride for a period of time between the time that the application liquid for photosensitive layer formation is prepared and the time that the application liquid for photosensitive layer formation is applied. The lower alcohol also remains in the formed photosensitive layer and reacts with the aromatic dicarboxylic acid dichloride. The reaction of the aromatic dicarboxylic acid dichloride with the lower alcohol produces hydrogen chloride and a dicarboxylic acid diester, and the produced hydrogen chloride is vaporized out of the photosensitive layer. It is considered that, as a result, the aromatic dicarboxylic acid dichloride contained in the photosensitive layer is reduced, and therefore, the charging characteristics of the photosensitive member are improved. Note that it is difficult for a binder resin typified by the polyarylate resin (PA1) to be dissolved in lower alcohols, and therefore, lower alcohols are typically not used in formation of a photosensitive layer.

In order to reduce the amount of the aromatic dicarboxylic acid dichloride remaining in the photosensitive layer, it is preferable to perform a standing treatment in which the application liquid for photosensitive layer formation is allowed to stand for a predetermined period of time between the time that the application liquid for photosensitive layer formation is formulated and the time that the application liquid for photosensitive layer formation is applied. Thus, by subjecting the application liquid for photosensitive layer formation to the standing treatment, the lower alcohol and the aromatic dicarboxylic acid dichloride can be sufficiently reacted together. Specifically, the period of time for which the standing treatment is performed (also hereinafter referred to as a "standing treatment time") is preferably 10 h or more, more preferably 20 h or more, even more preferably 40 h or more, particularly preferably 60 h or more, and most preferably 80 h or more. The standing treatment time is, for example, 120 h or less.

In the general formula (1), the alkyl group having a carbon number of at least 1 and no greater than 4 that is represented by $R^{11}$ and $R^{12}$ is preferably a methyl group or an ethyl group, more preferably a methyl group. It is preferable that both of $R^{11}$ and $R^{12}$ be a hydrogen atom or a methyl group.

In the general formula (1), the alkyl group having a carbon number of at least 1 and no greater than 4 that is represented by $R^{13}$ and $R^{14}$ is preferably a methyl group or an ethyl group. It is preferable that one of $R^{13}$ and $R^{14}$ represent a methyl group, and the other represent an ethyl group, or alternatively, $R^{13}$ and $R^{14}$ taken together represent the divalent group represented by the general formula (Y).

In the general formula (Y), examples of the monovalent substituent represented by $R^{20}$ include a halogen atom, an alkyl group having a carbon number of at least 1 and no greater than 8, and an aryl group having a carbon number of at least 6 and no greater than 14.

In the general formula (Y), p preferably represents an integer of at least 1 and no greater than 3, more preferably 2. q preferably represents 0.

The divalent group represented by the chemical formula (X4) is preferably a 1,4-naphthylene group or a 2,6-naphthylene group.

The monomer (1) preferably includes a compound represented by the following general formula (1-1) or chemical formula (1-2) (also hereinafter referred to as a "monomer (1-1)" or a "monomer (1-2)," respectively).

(1-1)

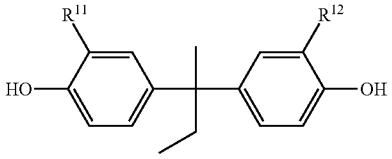

(1-2)

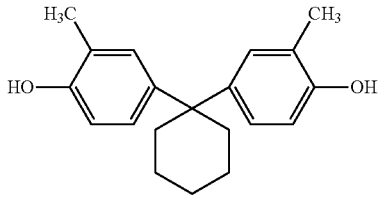

In the general formula (1-1), $R^{11}$ and $R^{12}$ are as defined in the general formula (1).

The monomer (2) preferably includes a compound represented by the following chemical formula (2-1) (also hereinafter referred to as a "monomer (2-1)").

(2-1)

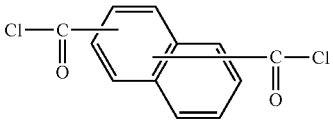

The monomer (2-1) preferably includes a compound represented by chemical formula (2-1-1) or (2-1-2) (also hereinafter referred to as a "monomer (2-1-1)" and a monomer (2-1-2)," respectively).

(2-1-1)

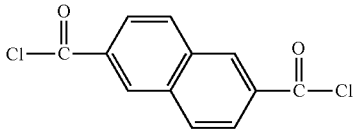

-continued (2-1-2)

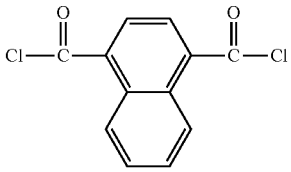

Concerning the monomers that are used in polymerization of the polyarylate resin (PA1), the monomer (1) preferably includes the monomer (1-2), and the monomer (2) preferably includes the monomers (2-1-1) and (2-1-2).

In the polyarylate resin (PA1), the ratio of the amount of substance of the repeating units derived from the monomers (1) and (2) to the amount of substance of all the repeating units (the amount of substance of the repeating units derived from the monomers (1) and (2)/the amount of substance of all the repeating units) is preferably 0.70 or more, more preferably 0.90 or more, and even more preferably 1.00. In the polyarylate resin (PA1), the ratio of the amount of substance of the repeating unit derived from the monomer (1) to the amount of substance of the repeating units derived from the monomers (1) and (2) (the amount of substance of the repeating unit derived from the monomer (1)/the amount of substance of the repeating units derived from the monomers (1) and (2)) is preferably at least 0.45 and no greater than 0.55.

Here, the number of repeating unit contained in the polyarylate resin (PA1) is the average of the number of repeating units in the entirety (a plurality of molecular chains) of the polyarylate resin (PA1) contained in the photosensitive layer, but not the number of repeating units of a single molecular chain of the polyarylate resin (PA1). The number of each repeating unit can be calculated from a $^{1}$H-NMR spectrum that is obtained by measuring the polyarylate resin (PA1) using a proton nuclear magnetic resonance spectrometer.

The polyarylate resin (PA1) preferably contains, as a repeating unit, at least one of repeating units represented by formulas (R-1) to (R-10) (also hereinafter referred to as "repeating units (R-1) to (R-10)," respectively). More preferably, the polyarylate resin (PA1) contains, as a repeating unit, only one or two of the repeating units (R-1) to (R-10).

(R-1)

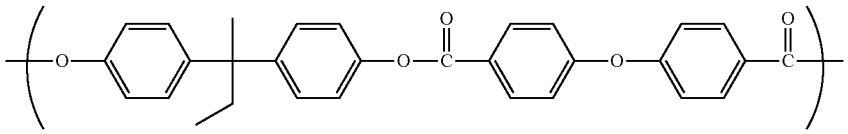

(R-2)

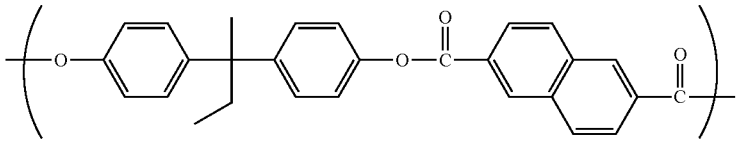

(R-3)

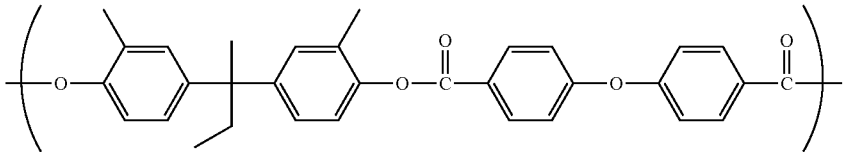

-continued (R-4)

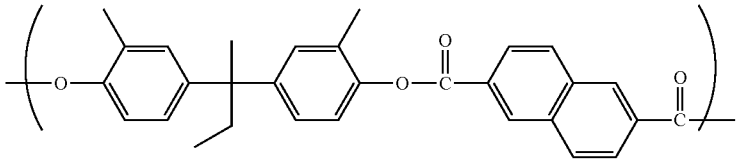

(R-5)

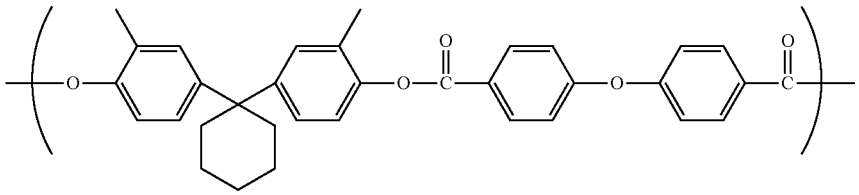

(R-6)

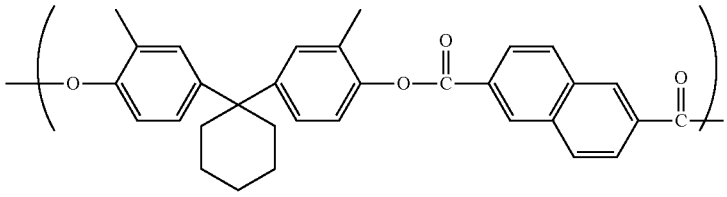

(R-7)

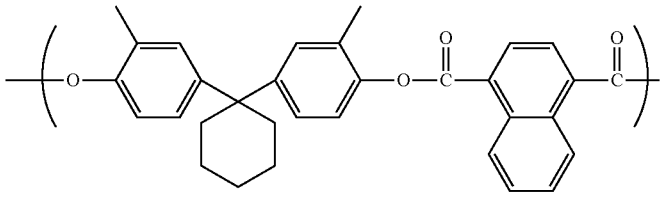

(R-8)

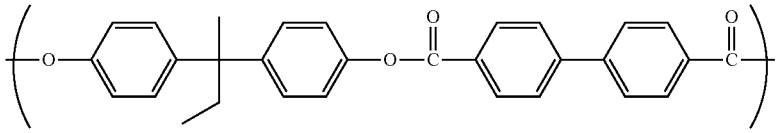

(R-9)

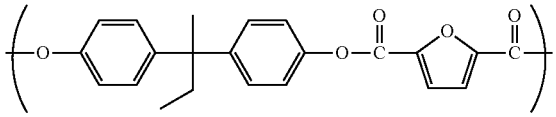

(R-10)

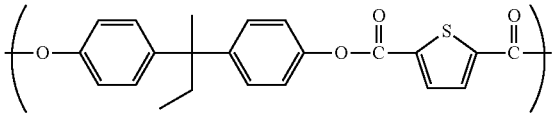

The polyarylate resin (PA1) preferably has, as a repeating unit:

the repeating unit (R-1) and the repeating unit (R-2);

the repeating unit (R-3) and the repeating unit (R-4);

the repeating unit (R-5) and the repeating unit (R-6);

the repeating unit (R-1);

the repeating unit (R-7) and the repeating unit (R-6);

the repeating unit (R-1) and the repeating unit (R-8);

the repeating unit (R-1) and the repeating unit (R-9); or the repeating unit (R-1) and the repeating unit (R-10).

As the polyarylate resin (PA1), those represented by chemical formulas (Resin-1) to (Resin-8) (also hereinafter referred to as "polyarylate resins (Resin-1) to (Resin-8)," respectively) are preferable. Note that a figure written to the lower right of a repeating unit in the following chemical formulas (Resin-1) to (Resin-8) indicates the percentage of the number of the repeating unit having that figure with respect to the number of all repeating units contained in the polyarylate resin (PA1). The polyarylate resins (Resin-1) to (Resin-8) may be any of a random copolymer, a block copolymer, a periodic copolymer, and an alternating copolymer.

(Resin-1)

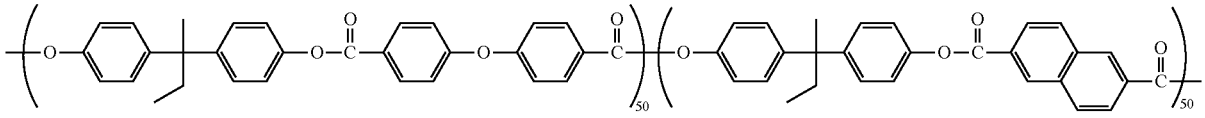

-continued (Resin-2)

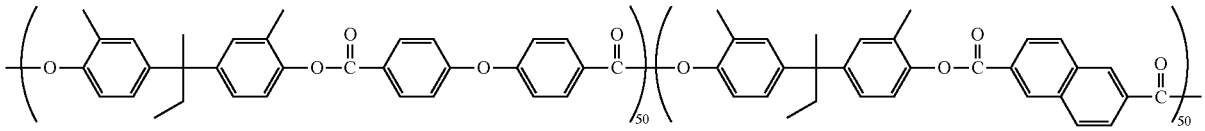

(Resin-3)

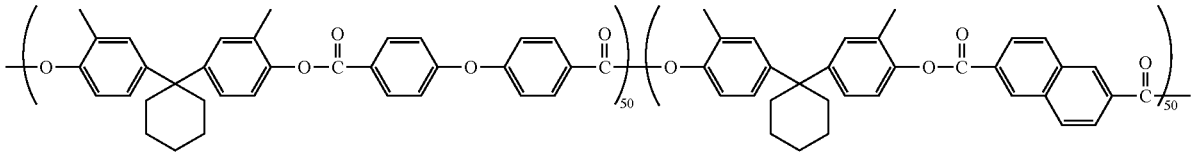

(Resin-4)

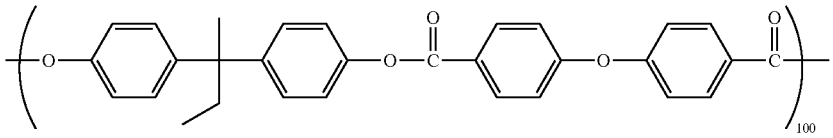

(Resin-5)

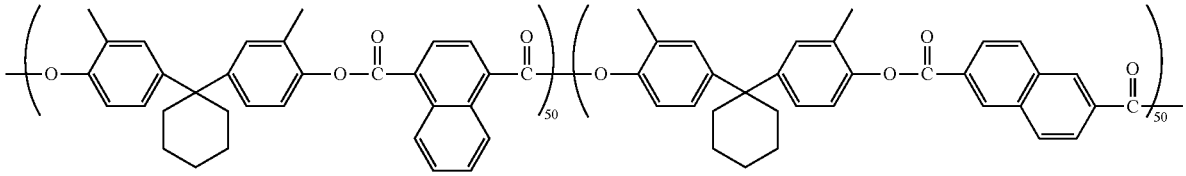

(Resin-6)

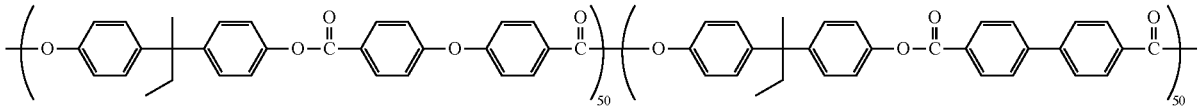

(Resin-7)

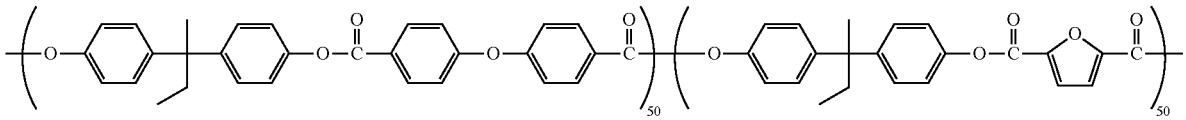

(Resin-8)

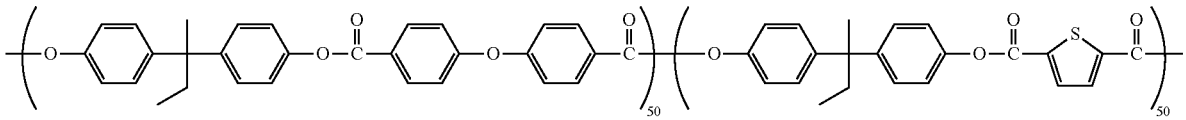

The viscosity average molecular weight of the polyarylate resin (PA1) is preferably 10,000 or more, more preferably 20,000 or more, even more preferably 30,000 or more, and particularly preferably 40,000 or more. In the case where the viscosity average molecular weight of the polyarylate resin (PA1) is 10,000 or more, the abrasion resistance of the photosensitive member is further improved. Meanwhile, the viscosity average molecular weight of the polyarylate resin (PA1) is preferably 80,000 or less, more preferably 70,000 or less. In the case where the viscosity average molecular weight of the polyarylate resin (PA1) is 80,000 or less, the polyarylate resin (PA1) is easily dissolved in the solvent of the application liquid for photosensitive layer formation, and therefore, the photosensitive layer is easily formed.

The production method for the polyarylate resin (PA1) is not particularly limited, and may be, for example, condensation polymerization of the monomers (1) and (2). The condensation polymerization can be carried out by known synthesis techniques (more specifically, for example, solution polymerization, melt polymerization, and interfacial polymerization). The polyarylate resin (PA1) may contain, in addition to the monomer (1), other aromatic diols or aromatic diacetates. The polyarylate resin (PA1) may also contain, in addition to the monomer (2), other aromatic dicarboxylic acid dichlorides, aromatic dicarboxylic acids, aromatic dicarboxylic acid dimethyl esters, aromatic dicarboxylic acid diethyl esters, and aromatic dicarboxylic anhydrides.

One or both of a base and a catalyst may be added in condensation polymerization of the monomers (1) and (2). The base and catalyst may be suitably selected from known bases and catalysts. An example of the base is sodium hydroxide. Examples of the catalyst include benzyl tributyl ammonium chloride, ammonium chloride, ammonium bromide, quaternary ammonium salts, triethyl amine, and trimethyl amine.

The application liquid for charge transport layer formation preferably contains, as the binder resin, only the polyarylate resin (PA1). Alternatively, the application liquid for photosensitive layer formation may contain other binder resins in addition to the polyarylate resin (PA1). The content ratio of the mass of the polyarylate resin (PA1) to the mass of the binder resin is preferably 80 mass % or more, more preferably 90 mass % or more, even more preferably 100 mass %.

Examples of other binder resins that may be contained in the application liquid for photosensitive layer formation include thermoplastic resins, thermosetting resins, and photocurable resins. Examples of thermoplastic resins include polycarbonate resins, polyarylate resins other than the polyarylate resin (PA1), styrene-butadiene copolymers, styrene-acrylonitrile copolymers, styrene-maleic acid copolymers, acrylic acid polymers, styrene-acrylic acid copolymers, polyethylene resins, ethylene-vinyl acetate copolymers, chlorinated polyethylene resins, polyvinyl chloride resins, polypropylene resins, ionomer resins, vinyl chloride-vinyl acetate copolymers, alkyd resins, polyamide resins, urethane resins, polysulfone resins, diallyl phthalate resins, ketone resins, polyvinyl butyral resins, polyester resins, polyvinyl acetal resins, and polyether resins. Examples of thermosetting resins include silicone resins, epoxy resins, phenolic resins, urea resins, and melamine resins. Examples of photocurable resins include acrylic acid adducts of epoxy compounds and acrylic acid adducts of urethane compounds. These binder resins may be used alone or in combination.

Examples of binder resins that may be contained in the electric charge generating layer application liquid for charge generating layer formation include binder resins similar to those that are exemplified above as the binder resin contained in the application liquid for charge transport layer formation. Note that in order to satisfactorily form the charge generating layer and the charge transport layer, the binder resin contained in the charge generating layer is preferably different from the binder resin contained in the charge transport layer. The binder resin contained in the charge generating layer is preferably a polyvinyl acetal resin.

(Hole Transport Material)

Examples of the hole transport material contained in the application liquid for charge transport layer formation include triphenyl amine derivatives, diamine derivatives (e.g., N,N,N',N'-tetraphenylbenzidine derivatives, N,N,N',N'-tetraphenylphenylenediamine derivatives, N,N,N',N'-tetraphenylnaphthylenediamine derivatives, N,N,N',N'-tetraphenylphenantolylenediamine derivatives, or di(aminophenylethenyl)benzene derivatives), oxadiazole-based compounds (e.g., 2,5-di(4-methylaminophenyl)-1,3,4-oxadiazole), styryl-based compounds (e.g., 9-(4-diethylaminostyryl)anthracene), carbazole-based compounds (e.g., polyvinyl carbazole), organic polysilane compounds, pyrazoline-based compounds (e.g., 1-phenyl-3-(p-dimethylaminophenyl)pyrazoline), hydrazone-based compounds, indole-based compounds, oxazole-based compounds, isoxazole-based compounds, thiazole-based compounds, thiadiazole-based compounds, imidazole-based compounds, pyrazole-based compounds, and triazole-based compounds. The hole transport materials may be used alone or in combination.

In order to improve the sensitivity and abrasion resistance of the photosensitive member, the hole transport material is preferably a compound represented by general formula (10), (11), (12), or (13) (also hereinafter referred to as "compounds (10), (11), (12), and (13)," respectively).

The compound (10) is represented by the following general formula (10).

(10)

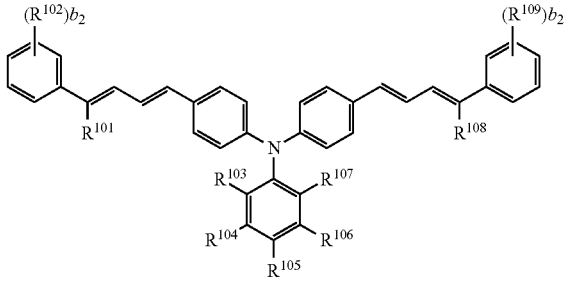

In the general formula (10), $R^{101}$, $R^{103}$, $R^{104}$, $R^{105}$, $R^{106}$, $R^{107}$, and $R^{108}$ each independently represent a hydrogen atom, an alkyl group having a carbon number of at least 1 and no greater than 8, a phenyl group optionally substituted with an alkyl group having a carbon number of at least 1 and no greater than 8, or an alkoxy group having a carbon number of at least 1 and no greater than 8. Two adjacent ones of $R^{103}$, $R^{104}$, $R^{105}$, $R^{106}$, and $R^{107}$ taken together may represent a cycloalkane having a carbon number of at least 5 and no greater than 7. $R^{102}$ and $R^{109}$ each independently represent an alkyl group having a carbon number of at least 1 and no greater than 8, a phenyl group, or an alkoxy group having a carbon number of at least 1 and no greater than 8. $b_1$ and $b_2$ each independently represent an integer of at least 0 and no greater than 5.

In the case when $b_1$ represents an integer of at least 2 and no greater than 5, a plurality of occurrences of $R^{102}$ may be the same or different. In the case when $b_2$ represents an integer of at least 2 and no greater than 5, a plurality of occurrences of $R^{109}$ may be the same or different.

In the general formula (10), the alkyl groups having a carbon number of at least 1 and no greater than 8 that are represented by $R^{101}$-$R^{109}$ are preferably an alkyl group having a carbon number of at least 1 and no greater than 6, more preferably an alkyl group having a carbon number of at least 1 and no greater than 4, and even more preferably a methyl group, an ethyl group, or an n-butyl group.

In the general formula (10), the phenyl groups represented by $R^{101}$ and $R^{103}$-$R^{108}$ may be substituted with an alkyl group having a carbon number of at least 1 and no greater than 8. The alkyl group having a carbon number of at least 1 and no greater than 8 possessed by the phenyl group is preferably an alkyl group having a carbon number of at least 1 and no greater than 6, more preferably an alkyl group having a carbon number of at least 1 and no greater than 4, and even more preferably a methyl group.

In the general formula (10), the alkoxy groups having a carbon number of at least 1 and no greater than 8 that are represented by $R^{101}$-$R^{109}$ are preferably an alkoxy group having a carbon number of at least 1 and no greater than 4, more preferably a methoxy group or an ethoxy group.

In the general formula (10), two adjacent ones (e.g., $R^{106}$ and $R^{107}$) of $R^{103}$, $R^{104}$, $R^{105}$, $R^{106}$, and $R^{107}$ taken together may represent a cycloalkane having a carbon number of at least 5 and no greater than 7. In the case when two adjacent ones of $R^{103}$, $R^{104}$, $R^{105}$, $R^{106}$, and $R^{107}$ are taken together to form a cycloalkane having a carbon number of at least 5 and no greater than 7, the cycloalkane having a carbon number of at least 5 and no greater than 7 is bonded to a phenyl group to which $R^{103}$, $R^{104}$, $R^{105}$, $R^{106}$, or $R^{107}$ are bonded, to form a fused bicyclic group. Note that the fusion sites between the cycloalkane having a carbon number of at least 5 and no greater than 7 and the phenyl group may include a double bond. The cycloalkane having a carbon number of at least 5 and no greater than 7 is preferably cyclohexane.

In order to further improve the sensitivity and abrasion resistance of the photosensitive member, $R^{101}$ and $R^{108}$ preferably represent a phenyl group substituted with an alkyl group having a carbon number of at least 1 and no greater than 8, or a hydrogen atom. $R^{102}$ and $R^{109}$ preferably represent an alkyl group having a carbon number of at least 1 and no greater than 8. $R^{103}$, $R^{104}$, $R^{105}$, $R^{106}$, and $R^{107}$ each preferably independently represent a hydrogen atom, an alkyl group having a carbon number of at least 1 and no greater than 8, or an alkoxy group having a carbon number of at least 1 and no greater than 8. Alternatively, two adjacent ones of $R^{103}$, $R^{104}$, $R^{105}$, $R^{106}$, and $R^{107}$ are preferably taken together to form a cycloalkane having a carbon number of at least 5 and no greater than 7. $b_1$ and $b_2$ each preferably independently represent 0 or 1.

Preferable examples of the compound (10) include compounds represented by chemical formulas (10-HT1), (10-HT2), (10-HT3), and (10-HT4) (also hereinafter referred to as "compounds (10-HT1), (10-HT2), (10-HT3), and (10-HT4)," respectively). In the chemical formulas (10-HT1) and (10-HT4), n-Bu and Me represent an n-butyl group and a methyl group, respectively.

(10-HT1)

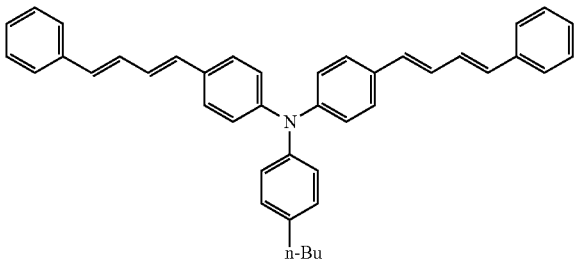

-continued (10-HT2)

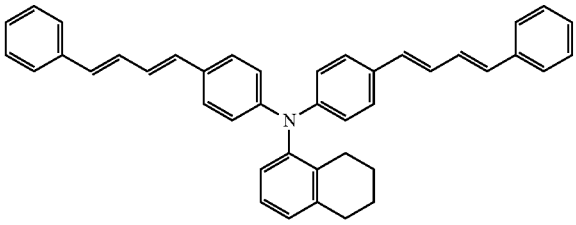

(10-HT3)

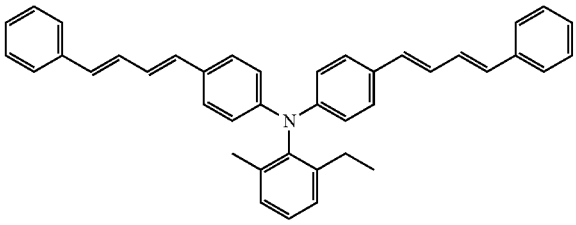

(10-HT4)

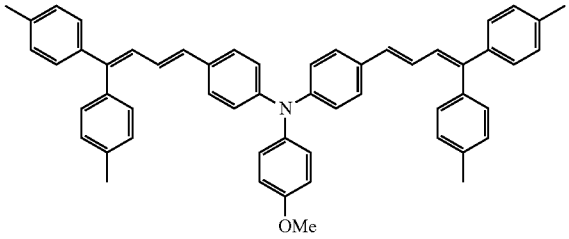

The compound (11) is represented by general formula (11).

(11)

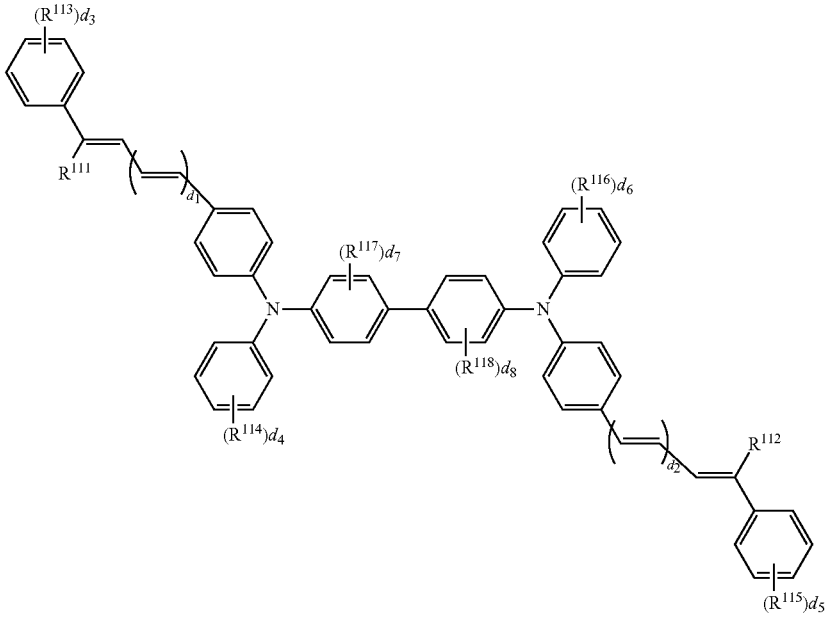

In the general formula (11), $R^{111}$ and $R^{112}$ each independently represent a hydrogen atom, an alkyl group having a carbon number of at least 1 and no greater than 8, or a phenyl group. $R^{113}$, $R^{114}$, $R^{115}$, $R^{116}$, $R^{117}$, and $R^{118}$ each independently represent an alkyl group having a carbon number of at least 1 and no greater than 8 or a phenyl group. $d_1$ and $d_2$ each independently represent 0 or 1. $d_3$, $d_4$, $d_5$, and $d_6$ each independently represent an integer of at least 0 and no greater than 5. $d_7$ and $d_8$ each independently represent an integer of at least 0 and no greater than 4, In the general formula (11), in the case when $d_3$ represents an integer of at least 2 and no greater than 5, a plurality of occurrences of $R^{113}$ may be the same or different. In the case when $d_4$ represents an integer of at least 2 and no greater than 5, a plurality of occurrences of $R^{114}$ may be the same or different. In the case when $d_5$ represents an integer of at least 2 and no greater than 5, a plurality of occurrences of $R^{115}$ may be the same or different. In the case when $d_6$ represents an integer of at least 2 and no greater than 5, a plurality of occurrences of $R^{116}$ may be the same or different. In the case when $d_7$ represents an integer of at least 2 and no greater than 4, a plurality of occurrences of $R^{117}$ may be the same or different. In the case when $d_8$ represents an integer of at least 2 and no greater than 4, a plurality of occurrences of $R^{118}$ may be the same or different.

In the general formula (11), the alkyl groups having a carbon number of at least 1 and no greater than 8 that are represented by $R^{111}$-$R^{118}$ are preferably an alkyl group having a carbon number of at least 1 and no greater than 4, more preferably a methyl group or an ethyl group.

In order to further improve the sensitivity and abrasion resistance of the photosensitive member, in the general formula (11), $R^{111}$ and $R^{112}$ each preferably represent a hydrogen atom or a phenyl group. $R^{113}$, $R^{114}$, $R^{115}$, $R^{116}$, $R^{117}$, and $R^{118}$ each preferably independently represent a methyl group or an ethyl group. $d_1$ and $d_2$ each preferably independently represent 0 or 1. $d_3$, $d_4$, $d_5$, and $d_6$ each preferably independently represent an integer of at least 0 and no greater than 2. $d_7$ and $d_8$ each preferably represent 0.

Preferable examples of the compound (11) include compounds represented by the following chemical formulas (11-HT5), (11-HT6), and (11-HT7) (also hereinafter referred to as "compounds (11-HT5), (11-HT6), and (11-HT7)," respectively).

(11-HT5)

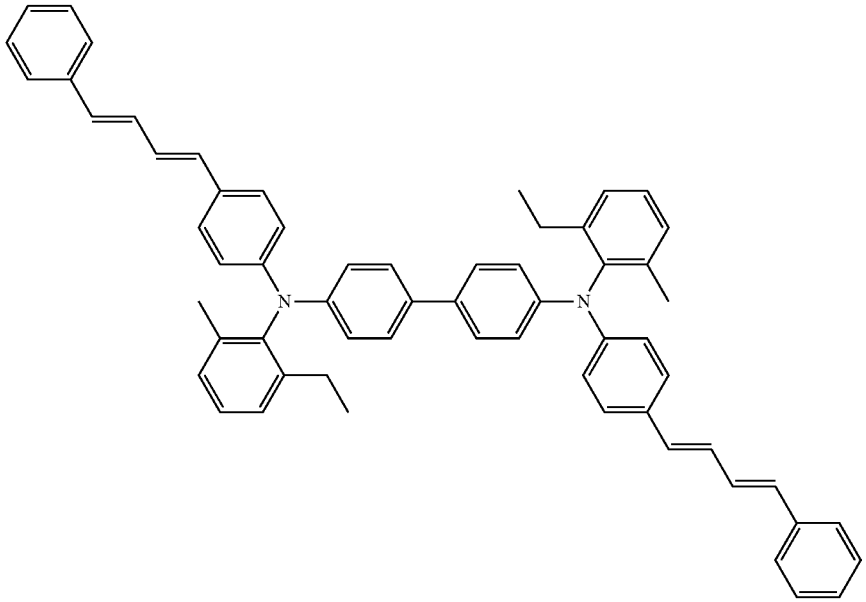

(11-HT6)

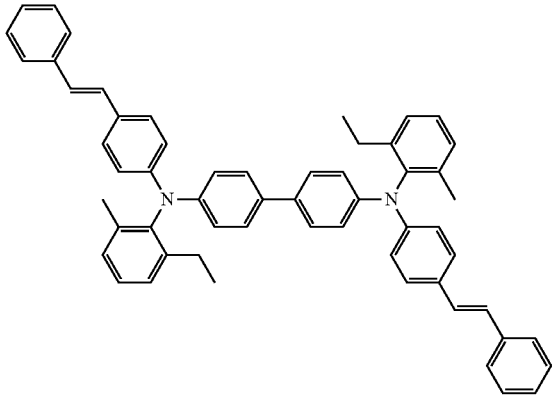

(11-HT7)

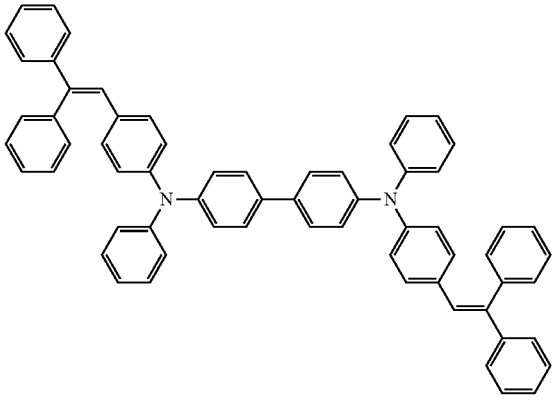

The compound (12) is represented by the following general formula (12).

(12)

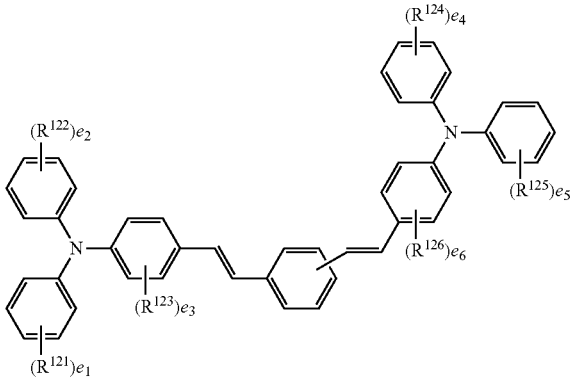

In the general formula (12), $R^{121}$, $R^{122}$, $R^{123}$, $R^{124}$, $R^{125}$ and $R^{126}$ each independently represent an alkyl group having a carbon number of at least 1 and no greater than 8, a phenyl group, or an alkoxy group having a carbon number of at least 1 and no greater than 8. $e_1$, $e_2$, $e_4$, and $e_5$ each independently represent an integer of at least 0 and no greater than 5. $e_3$ and $e_6$ each independently represent an integer of at least 0 and no greater than 4.

In the general formula (12), in the case when $e_1$ represents an integer of at least 2 and no greater than 5, a plurality of occurrences of $R^{121}$ may be the same or different. In the case when $e_2$ represents an integer of at least 2 and no greater than 5, a plurality of occurrences of $R^{122}$ may be the same or different. In the case when $e_3$ represents an integer of at least 2 and no greater than 4, a plurality of occurrences of $R^{123}$ may be the same or different. In the case when $e_4$ represents an integer of at least 2 and no greater than 5, a plurality of occurrences of $R^{124}$ may be the same or different. In the case when $e_5$ represents an integer of at least 2 and no greater than 5, a plurality of occurrences of $R^{125}$ may be the same or different. In the case when $e_6$ represents an integer of at least 2 and no greater than 4, a plurality of occurrences of $R^{126}$ may be the same or different.

In the general formula (12), the alkyl groups having a carbon number of at least 1 and no greater than 8 that are represented by $R^{121}$-$R^{126}$ are preferably an alkyl group having a carbon number of at least 1 and no greater than 4, more preferably a methyl group or an ethyl group.

In the general formula (12), $e_1$, $e_2$, $e_4$, and $e_5$ each preferably independently represent an integer of at least 0 and no greater than 2. Concerning $e_1$, $e_2$, $e_4$, and $e_5$, more preferably, one of $e_1$ and $e_2$ represents 0, and the other represents 2, and one of $e_4$ and $e_5$ represents 0, and the other represents 2. More preferably, $e_1$, $e_2$, $e_4$, and $e_5$ each represent 1. $e_3$ and $e_6$ each preferably represent 0.

In order to further improve the sensitivity and abrasion resistance of the photosensitive member, in the general formula (12), $R^{121}$, $R^{122}$, $R^{123}$, $R^{124}$, $R^{125}$ and $R^{126}$ each preferably independently represent an alkyl group having a carbon number of at least 1 and no greater than 8. $e_1$, $e_2$, $e_4$, and $e_5$ each preferably independently represent an integer of at least 0 and no greater than 2. $e_3$ and $e_6$ each preferably represent 0.

Preferable examples of the compound (12) include compounds represented by the following chemical formulas (12-HT8) and (12-HT9) (also hereinafter referred to as "compounds (12-HT8) and (12-HT9)," respectively).

(12-HT8)

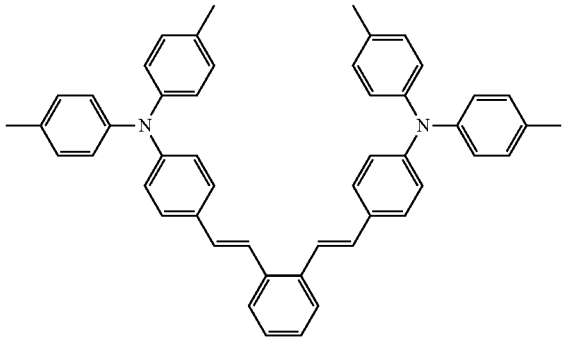

(12-HT9)

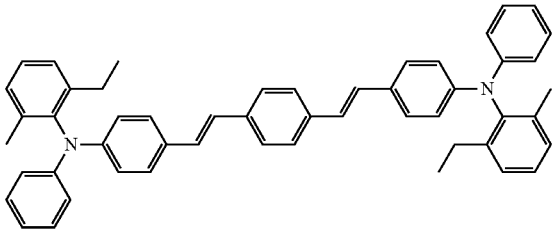

The compound (13) is represented by the following general formula (13).

(13)

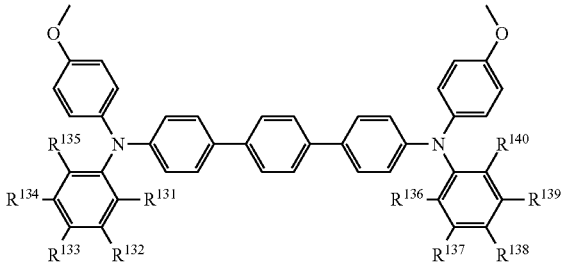

In the general formula (13), $R^{131}$, $R^{132}$, $R^{133}$, $R^{134}$, $R^{135}$, $R^{136}$, $R^{137}$, $R^{138}$, $R^{139}$, and $R^{140}$ each independently represent a hydrogen atom or a methyl group.

In the general formula (13), $R^{131}$, $R^{132}$, $R^{133}$, $R^{134}$, $R^{135}$, $R^{136}$, $R^{137}$, $R^{138}$, $R^{139}$, and $R^{140}$ each preferably represent a hydrogen atom.

Preferable examples of the compound (13) include a compound represented by the following chemical formula (13-HT10) (also hereinafter referred to as a "compound (13-HT10)").

(13-HT10)

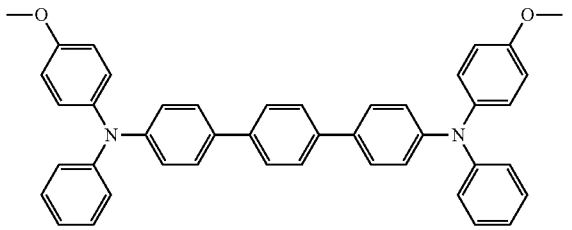

In order to further improve the abrasion resistance of the photosensitive member, the compounds (10-HT2), (11-HT5), and (12-HT9) are more preferable as the hole transport material.

The charge transport layer may contain, as the hole transport material, only the compound (10), (11), (12), or (13), or may further contain another hole transport material. The content of the compound (10), (11), (12), or (13) in the hole transport material is preferably 80 mass % or more, more preferably 90 mass % or more, and even more preferably 100 mass %.

The content of the hole transport material in the charge transport layer is preferably at least 10 parts by mass and no greater than 200 parts by mass, more preferably at least 20 parts by mass and no greater than 100 parts by mass, with respect to 100 parts by mass of the binder resin contained in the charge transport layer.

(Additives)

Examples of additives that may be contained in the application liquid for charge transport layer formation and the charge generating layer application liquid for charge generating layer formation include degradation prevention agents (e.g., antioxidants, radical scavengers, singlet quenchers, or UV absorbents), softeners, surface modifiers, fillers, thickeners, dispersion stabilizers, waxes, acceptors (e.g., electron acceptors), donors, surfactants, plasticizers, sensitizers, and leveling agents. Examples of antioxidants include hindered phenols (e.g., di(tert-butyl)p-cresol), hindered amines, para-phenylene diamines, arylalkanes, hydroquinone, spirochroman, spiroindanone, and derivatives thereof. Examples of antioxidants also include organic sulfur compounds and organic phosphorus compounds. Examples of leveling agents include dimethyl silicone oil. Examples of sensitizers include meta-terphenyl. The additive is preferably a degradation prevention agent, more preferably an antioxidant, and even more preferably a derivative of a hindered phenol.

In the case where the application liquid for charge transport layer formation and the charge generating layer application liquid for charge generating layer formation contain an additive, the content of the additive is preferably at least 0.1 parts by mass and no greater than 20 parts by mass, more preferably at least 1 parts by mass and no greater than 5 parts by mass, with respect to 100 parts by mass of the binder resins contained in the application liquid for charge transport layer formation and the charge generating layer application liquid for charge generating layer formation.

(Charge Generating Material)

Examples of the charge generating material contained in the charge generating layer include phthalocyanine-based pigments, perylene-based pigments, bisazo pigments, trisazo pigments, dithioketopyrrolopyrrole pigments, metal-free naphthalocyanine pigments, metal naphthalocyanine pigments, squaraine pigments, indigo pigments, azulenium pigments, cyanine pigments, powder of inorganic photoconductive materials (e.g., selenium, selenium-tellurium, selenium-arsenic, cadmium sulfide, or amorphous silicon), pyrylium pigments, anthanthrone-based pigments, triphenylmethane-based pigments, threne-based pigments, toluidine-based pigments, pyrazoline-based pigments, and quinacridone-based pigments. These charge generating materials may be used alone or in combination.

Examples of phthalocyanine-based pigments include metal-free phthalocyanine and metal phthalocyanines. Examples of metal phthalocyanines include titanyl phthalocyanine, hydroxygallium phthalocyanine, and chlorogallium phthalocyanine. Metal-free phthalocyanine is represented by chemical formula (CGM-1). Titanyl phthalocyanine is represented by chemical formula (CGM-2).

(CGM-1)

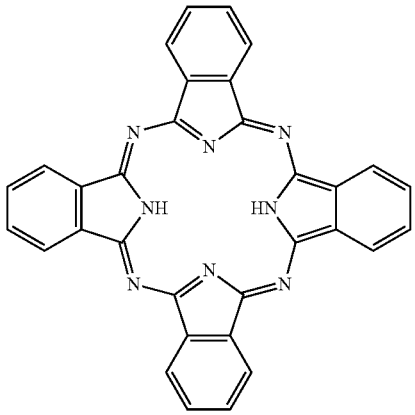

(CGM-2)

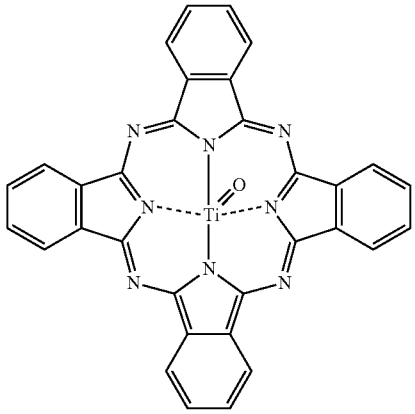

The phthalocyanine-based pigment may be either crystalline or non-crystalline. Examples of crystals of metal-free phthalocyanine include an X-type crystal of metal-free phthalocyanine (also hereinafter referred to as "X-type metal-free phthalocyanine"). Examples of crystals of titanyl phthalocyanine include α-, β-, and Y-type crystals of titanyl phthalocyanine (also hereinafter referred to as "α-, β-, and Y-type titanyl phthalocyanine," respectively).

For example, a digital optical image forming apparatus (e.g., a laser beam printer or facsimile including a light source such as a semiconductor laser) is preferably provided with a photosensitive member having sensitivity in a wavelength region of 700 nm or more. In order to provide such a photosensitive member that has a high quantum yield in the wavelength region of 700 nm or more, the charge generating material is preferably a phthalocyanine-based pigment, more preferably metal-free phthalocyanine or titanyl phthalocyanine, even more preferably X-type metal-free phthalocyanine or Y-type titanyl phthalocyanine, and particularly preferably Y-type titanyl phthalocyanine.

In the case of a photosensitive member applied to an image forming apparatus including a short-wavelength laser light source (e.g., a laser light source having a wavelength of at least 350 nm and no greater than 5 nm), the charge generating material is preferably an anthanthrone-based pigment.

The content of the charge generating material is preferably at least 0.1 parts by mass and no greater than 50 parts by mass, more preferably at least 0.5 parts by mass and no greater than 30 parts by mass, and even more preferably at least 0.5 parts by mass and no greater than 4.5 parts by mass, with respect to 100 parts by mass of the binder resin contained in the charge generating layer application liquid for charge generating layer formation.

(Combinations)

Preferable combinations of the hole transport material and binder resin contained in the application liquid for charge transport layer formation are combinations (k-1) to (k-17) shown in the following Table 1. Preferable combinations of the hole transport material, binder resin, and solvent contained in the application liquid for charge transport layer formation are combinations (j-1) to (j-23) shown in the following Table 2.

TABLE 1

| Combination | HTM | Binder resin |
|---|---|---|
| k-1 | 10-HT1 | Resin-1 |
| k-2 | 10-HT2 | Resin-1 |
| k-3 | 10-HT3 | Resin-1 |
| k-4 | 10-HT4 | Resin-1 |
| k-5 | 11-HT5 | Resin-1 |
| k-6 | 11-HT6 | Resin-1 |
| k-7 | 11-HT7 | Resin-1 |
| k-8 | 12-HT8 | Resin-1 |
| k-9 | 12-HT9 | Resin-1 |
| k-10 | 13-HT10 | Resin-1 |
| k-11 | 10-HT1 | Resin-2 |
| k-12 | 10-HT1 | Resin-3 |
| k-13 | 10-HT1 | Resin-4 |
| k-14 | 10-HT1 | Resin-5 |
| k-15 | 10-HT1 | Resin-6 |
| k-16 | 10-HT1 | Resin-7 |
| k-17 | 10-HT1 | Resin-8 |

TABLE 2

| | | | Solvents | |
|---|---|---|---|---|
| Combination | HTM | Binder resin | 1st solvent Type | 2nd solvent Type |
| j-1 | 10-HT1 | Resin-1 | Methanol | THF/toluene |
| j-2 | 10-HT2 | Resin-1 | Methanol | THF/toluene |
| j-3 | 10-HT3 | Resin-1 | Methanol | THF/toluene |
| j-4 | 10-HT4 | Resin-1 | Methanol | THF/toluene |
| j-5 | 11-HT5 | Resin-1 | Methanol | THF/toluene |
| j-6 | 11-HT6 | Resin-1 | Methanol | THF/toluene |
| j-7 | 11-HT7 | Resin-1 | Methanol | THF/toluene |
| j-8 | 12-HT8 | Resin-1 | Methanol | THF/toluene |
| j-9 | 12-HT9 | Resin-1 | Methanol | THF/toluene |
| j-10 | 13-HT10 | Resin-1 | Methanol | THF/toluene |
| j-11 | 10-HT1 | Resin-1 | Methanol | THF |
| j-12 | 10-HT1 | Resin-2 | Methanol | THF/toluene |
| j-13 | 10-HT1 | Resin-3 | Methanol | THF/toluene |
| j-14 | 10-HT1 | Resin-4 | Methanol | THF/toluene |

TABLE 2-continued

| | | | Solvents | |
|---|---|---|---|---|
| Combination | HTM | Binder resin | 1st solvent Type | 2nd solvent Type |
| j-15 | 10-HT1 | Resin-5 | Methanol | THF/toluene |
| j-16 | 10-HT1 | Resin-5 | 2-propanol | THF/toluene |
| j-17 | 10-HT1 | Resin-5 | Methanol | toluene |
| j-18 | 10-HT1 | Resin-5 | Methanol | Methylene chloride/toluene |
| j-19 | 10-HT1 | Resin-5 | Methanol | Chloroform/toluene |
| j-20 | 10-HT1 | Resin-5 | Methanol | 1,3-dioxolane/toluene |
| j-21 | 10-HT1 | Resin-6 | Methanol | THF/toluene |
| j-22 | 10-HT1 | Resin-7 | Methanol | THF/toluene |
| j-23 | 10-HT1 | Resin-8 | Methanol | THF/toluene |

[Production Method for Monolayer Electrophotographic Photosensitive Member]

Figure 4:
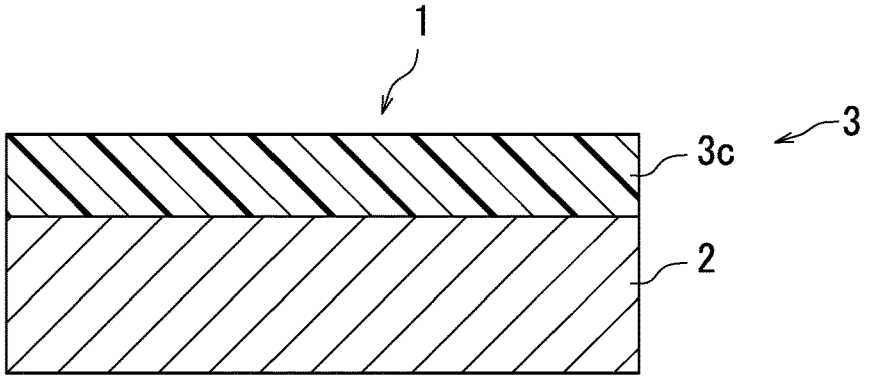
FIG. 4 is a partial cross-sectional view showing an example photosensitive member obtained by an electrophotographic photosensitive member production method according to the first embodiment of the present disclosure.
Figure 5:
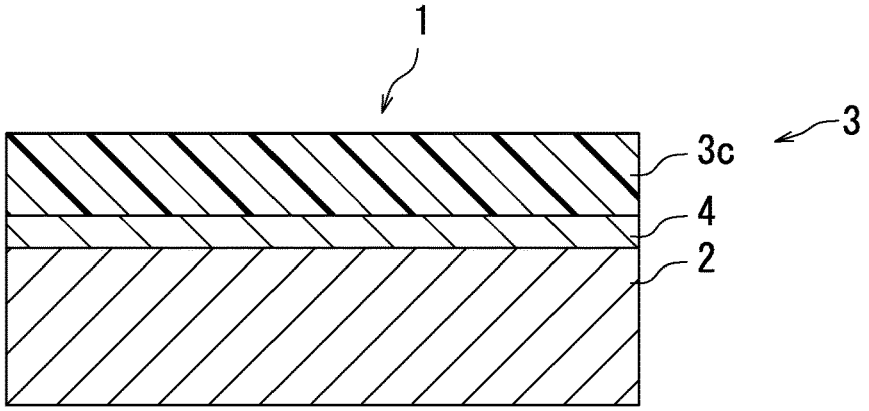
FIG. 5 is a partial cross-sectional view showing an example photosensitive member obtained by an electrophotographic photosensitive member production method according to the first embodiment of the present disclosure.
Figure 6:
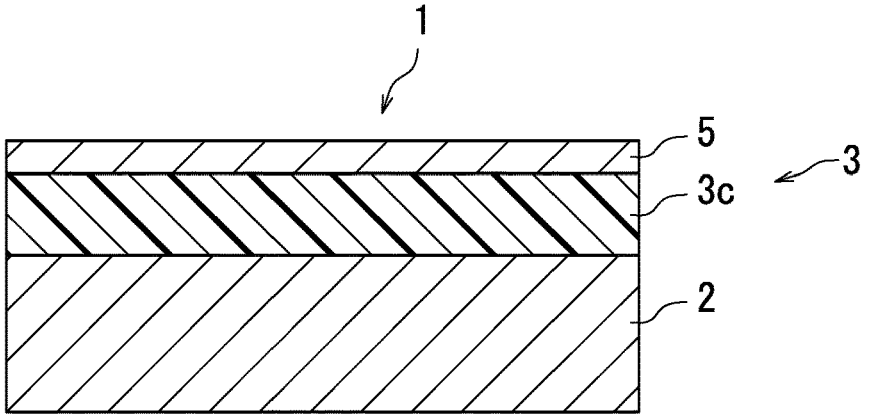
FIG. 6 is a partial cross-sectional view showing an example photosensitive member obtained by an electrophotographic photosensitive member production method according to the first embodiment of the present disclosure.

The monolayer photosensitive member production method will now be described. Note that steps common to the monolayer and multilayer photosensitive member production methods will not be redundantly described. Firstly, a monolayer photosensitive member obtained by this method will be described. FIGS. 4-6 are each a partial cross-sectional view showing an example of a photosensitive member 1 that is a monolayer photosensitive member.

As shown in FIG. 4, the monolayer photosensitive member 1 includes, for example, an electrically conductive substrate 2 and a photosensitive layer 3. The photosensitive layer 3 of the monolayer photosensitive member 1 is a single layer (also hereinafter referred to as a "monolayer photosensitive layer 3*c*").

As shown in FIG. 5, the monolayer photosensitive member 1 may include an electrically conductive substrate 2, a monolayer photosensitive layer 3*c*, and a middle layer 4 (undercoat layer). The middle layer 4 is provided between the electrically conductive substrate 2 and the monolayer photosensitive layer 3*c*. As shown in FIG. 4, the photosensitive layer 3 may be provided directly on the electrically conductive substrate 2. Alternatively, as shown in FIG. 5, the photosensitive layer 3 may be provided on the electrically conductive substrate 2 with the middle layer 4 interposed therebetween.

As shown in FIG. 6, the monolayer photosensitive member 1 may include an electrically conductive substrate 2, a monolayer photosensitive layer 3*c*, and a protective layer 5. The protective layer 5 is provided on the monolayer photosensitive layer 3*c*.

The thickness of the monolayer photosensitive layer 3*c* is not particularly limited, and may be preferably at least 5 μm and no greater than 100 μm, more preferably at least 10 μm and no greater than 50 μm.

The monolayer photosensitive layer 3*c* as the photosensitive layer 3 contains a charge generating material, a binder resin, and a hole transport material. The monolayer photosensitive layer 3*c* may further contain an electron transport material. The monolayer photosensitive layer 3*c* may optionally contain an additive. The electrically conductive substrate 2 and the middle layer 4 included in the monolayer photosensitive member 1 may be similar to those of the multilayer photosensitive member 1. In the foregoing, the monolayer photosensitive member 1 has been outlined with reference to FIGS. 4-6.

(Monolayer Photosensitive Layer Formation Step)

Each step of a method for producing the monolayer photosensitive member will now be described. The monolayer photosensitive member production method includes a step of applying an application liquid for photosensitive layer formation containing a solvent, a binder resin, and a hole transport material (also hereinafter referred to as a "application liquid for monolayer photosensitive layer formation") directly or indirectly onto an electrically conductive substrate, and removing a portion of the solvent, to form a monolayer photosensitive layer (also hereinafter referred to as a "monolayer photosensitive layer formation step").

Note that the monolayer photosensitive member production method may optionally further have a step of forming a middle layer. The middle layer may be formed by any suitable known technique.

The application liquid for monolayer photosensitive layer formation may further contain an electron transport material. The application liquid for monolayer photosensitive layer formation may further contain an additive so that the formed photosensitive member has desired characteristics.

The solvent, binder resin, hole transport material, charge generating material, and additive contained in the application liquid for monolayer photosensitive layer formation may be similar to those that are exemplified as the components of the application liquid for charge transport layer formation and the charge generating layer application liquid for charge generating layer formation. The techniques of formulating and applying the application liquid for monolayer photosensitive layer formation, and the technique of removing a portion of the solvent, may be similar to those that are exemplified for the application liquid for charge transport layer formation and the charge generating layer application liquid for charge generating layer formation.

Second Embodiment: Application Liquid for Photosensitive Layer Formation

An application liquid for photosensitive layer formation according to a second embodiment is one that is used to form a photosensitive layer of an electrophotographic photosensitive member, and contains a solvent, a binder resin, and a hole transport material. The solvent includes a first solvent that is an alcohol having a carbon number of at least 1 and no greater than 3, and a second solvent other than the first solvent. The binder resin includes a polyarylate resin (also hereinafter referred to as "polyarylate resin (PA2)") having a first repeating unit represented by the following general formula (20), and a second repeating unit represented by the following general formula (21).

(20)

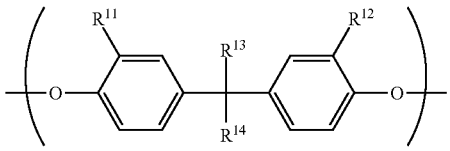

(21)

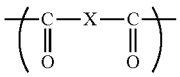

In the general formula (20), $R^{11}$ and $R^{12}$ each independently represent a hydrogen atom or an alkyl group having a carbon number of at least 1 and no greater than 4. $R^{13}$ and $R^{14}$ each independently represent a hydrogen atom, an alkyl group having a carbon number of at least 1 and no greater than 4, or a phenyl group, or $R^{13}$ and $R^{14}$ taken together represent a divalent group represented by the following general formula (Y). In the general formula (21), X represents a divalent group represented by the following chemical formula (X1), (X2), (X3), (X4), (X5), or (X6).

(Y)

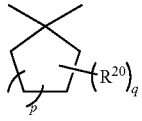

In the general formula (Y), $R^{20}$ represents a monovalent substituent. p represents an integer of at least 1 and no greater than 6. q represents an integer of at least 0 and no greater than 5.

(X1)

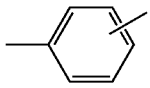

(X2)

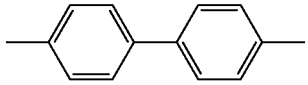

(X3)

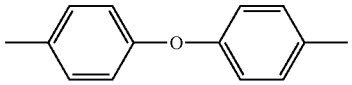

(X4)

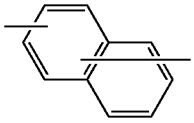

(X5)

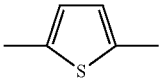

(X6)

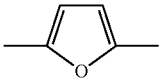

The application liquid for photosensitive layer formation of the second embodiment can, for example, be used for production of a multilayer photosensitive member including a charge transport layer and a charge generating layer as photosensitive layers, or production of a monolayer photosensitive member including a monolayer photosensitive layer. The specifics of the application liquid for photosensitive layer formation used for production of a multilayer photosensitive member may be similar to those of the application liquid for charge transport layer formation used in the photosensitive member production method of the first embodiment. The specifics of the application liquid for photosensitive layer formation used for production of a monolayer photosensitive member are similar to those of the application liquid for monolayer photosensitive layer formation used in the photosensitive member production method of the first embodiment. The polyarylate resin (PA2) is also similar to the polyarylate resin (PA1) described in the first embodiment. Therefore, $R^{11}$-$R^{14}$, X, $R^{20}$, p, and q in the general formulas (20), (21), and (Y) of the second embodiment are defined similarly to those in the general formulas (1), (2), and (Y) of the first embodiment.

Third Embodiment: Electrophotographic Photosensitive Member

A photosensitive member according to a third embodiment of the present disclosure includes an electrically conductive substrate and a photosensitive layer. The photosensitive layer contains an alcohol having a carbon number of at least 1 and no greater than 3 (lower alcohol), a binder resin, and a hole transport material. The binder resin includes a polyarylate resin (also hereinafter referred to as a "polyarylate resin (PA2)") having a first repeating unit represented by the following general formula (20) and a second repeating unit represented by the following general formula (21).

(20)

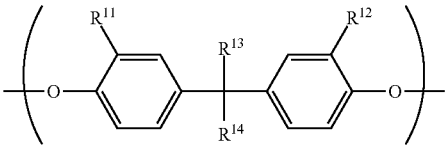

(21)

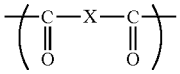

In the general formula (20), $R^{11}$ and $R^{12}$ each independently represent a hydrogen atom or an alkyl group having a carbon number of at least 1 and no greater than 4. $R^{13}$ and $R^{14}$ each independently represent a hydrogen atom, an alkyl group having a carbon number of at least 1 and no greater than 4, or a phenyl group, or $R^{13}$ and $R^{14}$ taken together represent a divalent group represented by the following general formula (Y). In the general formula (21), X represents a divalent group represented by the following chemical formula (X1), (X2), (X3), (X4), (X5), or (X6).

(Y)

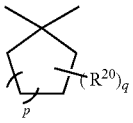

In the general formula (Y), $R^{20}$ represents a monovalent substituent. p represents an integer of at least 1 and no greater than 6. q represents an integer of at least 0 and no greater than 5.

(X1)

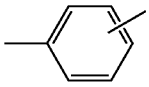

(X2)

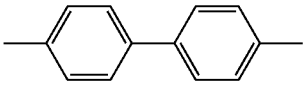

(X5)

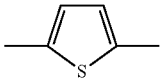

-continued (X3)

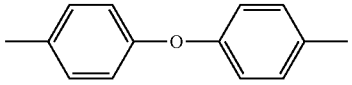

(X6)

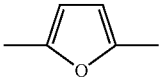

(X4)

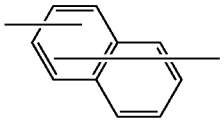

Examples of the photosensitive member of the third embodiment include a multilayer photosensitive member including a charge transport layer and a charge generating layer as photosensitive layers, and a monolayer photosensitive member including a monolayer photosensitive layer. The multilayer photosensitive member and the monolayer photosensitive member are similar to those described as the photosensitive member produced by the photosensitive member production method of the first embodiment.

The charge transport layer included in the multilayer photosensitive member contains a lower alcohol, a binder resin, and a hole transport material, and may further contain an additive. The charge generating layer included in the multilayer photosensitive member contains a charge generating material, and may further contain a binder resin and an additive. The monolayer photosensitive layer included in the monolayer photosensitive member contains a lower alcohol, a binder resin, and a hole transport material, and may further contain an electron transport material and an additive. The types of components contained in the charge transport layer, the charge generating layer, and the monolayer photosensitive layer may be similar to those of the application liquid for charge transport layer formation and the charge generating layer application liquid for charge generating layer formation of the first embodiment. The contents of the hole transport material, the additive, and the charge generating material in the charge transport layer and the charge generating layer may be respectively similar to those in the application liquid for charge transport layer formation and the charge generating layer application liquid for charge generating layer formation of the first embodiment.

The lower alcohol contained in the photosensitive layer is the residual first solvent of the application liquid for photosensitive layer formation (the application liquid for charge transport layer formation for production of the multilayer photosensitive member, and the application liquid for monolayer photosensitive layer formation for production of the monolayer photosensitive member).

The polyarylate resin (PA2) is similar to the polyarylate resin (PA1) described in the first embodiment. Therefore, $R^{11}$-$R^{14}$, X, $R^{20}$, p, and q in the general formulas (20), (21), and (Y) of the third embodiment are defined similarly to those in the general formula (1), (2), and (Y) of the first embodiment, In order to further improve the charging characteristics of the photosensitive member, the content proportion of the lower alcohol in the photosensitive layer is preferably at least 1 ppm and no greater than 50,000 ppm, more preferably at least 100 ppm and no greater than 10,000 ppm.

Here, in the case where the photosensitive layer includes a plurality of layers, and at least one of the layers contains a lower alcohol, the content of the lower alcohol in the photosensitive layer means the lower alcohol content of the at least one layer containing the lower alcohol. For example, in the case where the photosensitive member is a multilayer photosensitive member, and the charge transport layer that is a photosensitive layer contains a lower alcohol, the content of the lower alcohol in the photosensitive layer means the lower alcohol content of the charge transport layer.

The above photosensitive member production method according to the first embodiment of the present disclosure and the application liquid for photosensitive layer formation according to the second embodiment of the present disclosure can provide a photosensitive member having excellent charging characteristics and abrasion resistance. The photosensitive member according to the third embodiment of the present disclosure has excellent charging characteristics and abrasion resistance.

EXAMPLES

The present disclosure will be more specifically described by way of example. The present disclosure is in no way limited to examples below.

As materials for formation of a charge transport layer in a multilayer photosensitive member, the following hole transport materials and binder resins were prepared.

(Hole Transport Material) As hole transport materials, the compounds (10-HT1) to (13-HT10) described in the first embodiment were prepared.

(Binder Resins) As binder resin, the polyarylate resins (Resin-1) to (Resin-8) described in the first embodiment were synthesized using the following synthesis techniques.

<Synthesis of Polyarylate Resins>

[Synthesis Polyarylate Resin (Resin-5)]

A three-neck flask was used as a reaction container. The three-neck flask as a reaction container was equipped with a thermometer, a 3-way stopcock, and a 200-mL dropper funnel, and had a capacity of 1 L. In the reaction container, placed were 12.24 g (41.28 mmol) of 1,1-bis(4-hydroxy-3-methylphenyl)cyclohexane, 0.062 g (0.413 mmol) of t-butyl phenol, 3.92 g (98 mmol) of sodium hydroxide, and 0.120 g (0.384 mmol) of benzyl tributyl ammonium chloride. Next, the reaction container was purged with argon. Thereafter, 300 mL of water was also added to the reaction container. The internal temperature of the reaction container was increased to 50° C. While the internal temperature of the reaction container was maintained at 50° C., the contents of the reaction container were stirred for 1 h. Thereafter, the internal temperature of the reaction container was cooled to 10° C. As a result, an alkaline aqueous solution was obtained.

Meanwhile, 4.10 g (16.2 mmol) of 2,6-naphthalenedicarbonyl dichloride, and 4.10 g (16.2 mmol) of 1,4-naphthalenedicarbonyl dichloride, were dissolved in 150 mL of chloroform (amylene (registered Japanese trademark) added). As a result, a chloroform solution was obtained.

Next, the chloroform solution was slowly dropped from the dropper funnel into the alkaline aqueous solution in 110 min, to initiate a polymerization reaction. The internal temperature of the reaction container was adjusted to 15±5° C. and the contents of the reaction container were stirred for 4 h so that the polymerization reaction proceeded.

Thereafter, a top layer (aqueous layer) of the contents of the reaction container was removed by decantation to obtain an organic layer. Next, 400 mL of ion-exchanged water was placed in a 1 L three-neck flask, and thereafter, the organic layer was added to the flask. Furthermore, 400 mL of chloroform and 2 mL of acetic acid were added. The contents of the three-neck flask were stirred at room temperature (25° C.) for 30 min. Thereafter, a top layer (aqueous layer) of the contents of the three-neck flask was removed by decantation to obtain an organic layer. The organic layer thus obtained was washed with 1 L of water five times using a separatory funnel. As a result, a water-washed organic layer was obtained.

Next, the water-washed organic layer was subjected to filtration to obtain a filtrate. One liter of methanol was placed in a 1 L Erlenmeyer flask. The obtained filtrate was slowly dropped into the Erlenmeyer flask to obtain a precipitate. The precipitate was separated by filtration. The precipitate thus obtained was dried in a vacuum at a temperature of 70° C. for 12 h. As a result, the polyarylate resin (Resin-5) was obtained. The amount of the polyarylate resin (Resin-5) thus obtained was 12.9 g, and the yield was 83.5 mol %.

[Synthesis of Polyarylate Resins (Resin-1) to (Resin-4) and (Resin-6) to (Resin-8)]

In synthesis of the polyarylate resins (Resin-1) to (Resin-4) and (Resin-6) to (Resin-8), monomers from which repeating units can be derived and which are represented by the general formula (1) or (2) were suitably used. Except for that, the polyarylate resins (Resin-1) to (Resin-4) and (Resin-6) to (Resin-8) were synthesized in a manner similar to that for synthesis of the polyarylate resin (Resin-5).

Note that each polyarylate resin had the following viscosity average molecular weight.

Polyarylate resin (Resin-1): 49,300
Polyarylate resin (Resin-2): 54,400
Polyarylate resin (Resin-3): 54,000
Polyarylate resin (Resin-4): 54,200
Polyarylate resin (Resin-5): 50,500
Polyarylate resin (Resin-6): 55,100
Polyarylate resin (Resin-7): 52,300
Polyarylate resin (Resin-8): 51,900

Next, a $^1$H-NMR spectrum of each of the prepared polyarylate resins (Resin-1) to (Resin-8) was measured using a proton nuclear magnetic resonance spectrometer (manufactured by JASCO Corporation, 300 MHz). $CDCl_3$ was used as a solvent. Tetramethyl silane (TMS) was used as an internal standard sample. Based on the $^1$H-NMR spectra, it was confirmed that the polyarylate resins (Resin-1) to (Resin-8) were obtained.

A polycarbonate resin (Resin-A) represented by the following chemical formula (Resin-A) was also prepared. The polycarbonate resin (Resin-A) had a viscosity average molecular weight of 53,000.

(Resin-A)

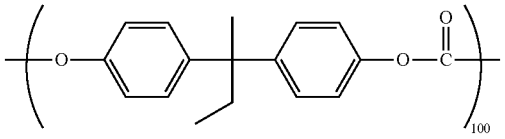

[Production of Photosensitive Member (A-1)]

A production method for a photosensitive member (A-1) according to Example 1 will now be described.

(Formation of Middle Layer) Initially, surface-treated titanium oxide ("Prototype SMT-A," manufactured by Tayca Corporation, the average primary particle size: 10 nm) was prepared. Specifically, titanium oxide was subjected to a surface treatment using alumina and silica, and the surface-treated titanium oxide was further subjected to a surface treatment using methyl hydrogen polysiloxane while being subjected to wet dispersion. Next, the surface-treated titanium oxide (2 parts by mass) and a polyamide resin ("AMILAN (registered Japanese trademark) CM8000," manufactured by Toray Industries, Inc.) (1 part by mass) were added to a mixed solvent. The mixed solvent contained methanol (10 parts by mass), butanol (1 part by mass), and toluene (1 part by mass). The polyamide resin was a quaternary copolymer of polyamide 6, polyamide 12, polyamide 66, and polyamide 610. These were mixed for 5 h using a bead mill so that the materials (the surface-treated titanium oxide and the polyamide resin) were dispersed in the mixed solvent. As a result, a application liquid for middle layer formation was obtained.

The application liquid for middle layer formation thus obtained was subjected to filtration using a filter having a mesh opening size of 5 μm. Next, the application liquid for middle layer formation was applied to a surface of an electrically conductive substrate by dip coating, to form a coating film. The electrically conductive substrate was a drum-shaped support made of aluminum (diameter: 30 mm, and length: 246 mm). Next, the coating film was dried at 130° C. for 30 min to form a middle layer (thickness: 2 μm) on the electrically conductive substrate.

(Formation of Charge Generating Layer)

Y-type titanyl phthalocyanine (1.5 parts by mass), and a polyvinyl acetal resin ("S-LEC KX-5," manufactured by Sekisui Chemical Co., Ltd.) (1 part by mass) as a binder resin, were added to a mixed solvent. The mixed solvent contained propylene glycol monomethyl ether (40 parts by mass) and tetrahydrofuran (40 parts by mass). These were mixed for 2 h using a bead mill so that the materials (the Y-type titanyl phthalocyanine and the polyvinyl acetal resin) were dispersed in the mixed solvent. As a result, an charge generating layer application liquid for charge generating layer formation was obtained.

The charge generating layer application liquid for charge generating layer formation thus obtained was subjected to filtration using a filter having a mesh opening size of 3 μm. Next, the obtained filtrate was applied by dip coating to the middle layer formed as described above, to form a coating film. The coating film was dried at 50° C. for 5 min. As a result, a charge generating layer (thickness: 0.3 μm) was formed on the middle layer.

(Formation of Charge Transport Layer)

Fifty parts by mass of the compound (10-HT1) as a hole transport material, 2 parts by mass of an antioxidant ("IRGANOX (registered Japanese trademark) 1010," manufactured by BASF) as an additive, and 100 parts by mass of a polyarylate resin (Resin-1) (viscosity average molecular weight: 50,500) as a binder resin, were added to a mixed solvent. The mixed solvent contained 650 parts by mass of tetrahydrofuran (THF) and 50 parts by mass of toluene, which are a second solvent, and 14 parts by mass of methanol (MeOH), which is a first solvent. The content of the first solvent in the mixed solvent was 2.0 mass %. These were mixed so that the materials (the hole transport material (10-HT1), the antioxidant, and the polyarylate resin (Resin-1)) were dispersed in the mixed solvent, to formulate an application liquid for charge transport layer formation. After the formulation, the application liquid for charge transport layer formation was allowed to stand for 48 h.

The application liquid for charge transport layer formation was applied onto the charge generating layer to form a coating film in a manner similar to that for the charge generating layer application liquid for charge generating layer formation. Next, the coating film was dried at 120° C. for 40 min to form a charge transport layer (thickness: 20 μm) on the charge generating layer. As a result, the photosensitive member (A-1) was obtained. The photosensitive member (A-1) had a structure in which the middle layer, the charge generating layer, and the charge transport layer are stacked in that order on the electrically conductive substrate.

[Photosensitive members (A-2) to (A-25) and (B-1) to (B-4)]

The photosensitive members (A-2) to (A-25) and (B-1) to (B-4) were produced in a manner similar to that for the photosensitive member (A-1), except that hole transport materials, binder resins, and solvents were changed as shown in Table 3.

In Table 3, 10-HT1 to 13-HTM10 in the column "HTM" represent the compounds (10-HT1) to (13-HT10), respectively. Resin-1 to Resin-8 and Resin-A in the column "Binder resin" represent the polyarylate resins (Resin-1) to (Resin-8) and the polycarbonate resin (Resin-A), respectively. The column "Content proportion" for the first solvent means the ratio (mass %) of the mass of the first solvent to the total mass of the first and second solvents. The column "Parts" means "parts by mass" with respect to 100 parts by mass of a binder resin. The symbol "-" for the type, parts, and content proportion of the first solvent indicates that the first solvent does not contain the corresponding component. The type "THF/toluene" and the parts "650/50" of the second solvent mean that the second solvent contains 650 parts by mass of tetrahydrofuran and 50 parts by mass of toluene. These hold true of the other second solvents.

TABLE 3

| | Photosensitive member | HTM | Binder resin | Solvents: 1st solvent Type | Parts | Content proportion [%] | 2nd solvent Type | Parts |
|---|---|---|---|---|---|---|---|---|
| Example 1 | A-1 | 10-HT1 | Resin-1 | Methanol | 14 | 2.0 | THF/toluene | 650/50 |
| Example 2 | A-2 | 10-HT2 | Resin-1 | Methanol | 14 | 2.0 | THF/toluene | 650/50 |
| Example 3 | A-3 | 10-HT3 | Resin-1 | Methanol | 14 | 2.0 | THF/toluene | 650/50 |
| Example 4 | A-4 | 10-HT4 | Resin-1 | Methanol | 14 | 2.0 | THF/toluene | 650/50 |
| Example 5 | A-5 | 11-HT5 | Resin-1 | Methanol | 14 | 2.0 | THF/toluene | 650/50 |
| Example 6 | A-6 | 11-HT6 | Resin-1 | Methanol | 14 | 2.0 | THF/toluene | 650/50 |
| Example 7 | A-7 | 11-HT7 | Resin-1 | Methanol | 14 | 2.0 | THF/toluene | 650/50 |
| Example 8 | A-8 | 12-HT8 | Resin-1 | Methanol | 14 | 2.0 | THF/toluene | 650/50 |
| Example 9 | A-9 | 12-HT9 | Resin-1 | Methanol | 14 | 2.0 | THF/toluene | 650/50 |
| Example 10 | A-10 | 13-HT10 | Resin-1 | Methanol | 14 | 2.0 | THF/toluene | 650/50 |
| Example 11 | A-11 | 10-HT1 | Resin-1 | Methanol | 14 | 2.0 | THF | 700 |
| Example 12 | A-12 | 10-HT1 | Resin-2 | Methanol | 14 | 2.0 | THF/toluene | 650/50 |

TABLE 3-continued

| | Photosensitive member | HTM | Binder resin | Solvents: 1st solvent Type | Parts | Content proportion [%] | 2nd solvent Type | Parts |
|---|---|---|---|---|---|---|---|---|
| Example 13 | A-13 | 10-HT1 | Resin-3 | Methanol | 14 | 2.0 | THF/toluene | 650/50 |
| Example 14 | A-14 | 10-HT1 | Resin-4 | Methanol | 14 | 2.0 | THF/toluene | 650/50 |
| Example 15 | A-15 | 10-HT1 | Resin-5 | Methanol | 14 | 2.0 | THF/toluene | 650/50 |
| Example 16 | A-16 | 10-HT1 | Resin-5 | 2-propanol | 14 | 2.0 | THF/toluene | 650/50 |
| Example 17 | A-17 | 10-HT1 | Resin-5 | Methanol | 14 | 2.0 | toluene | 700 |
| Example 18 | A-18 | 10-HT1 | Resin-5 | Methanol | 14 | 2.0 | Methylene chloride/toluene | 650/50 |
| Example 19 | A-19 | 10-HT1 | Resin-5 | Methanol | 14 | 2.0 | Chloroform/toluene | 650/50 |
| Example 20 | A-20 | 10-HT1 | Resin-5 | Methanol | 14 | 2.0 | 1,3-dioxolane/toluene | 650/50 |
| Example 21 | A-21 | 10-HT1 | Resin-6 | Methanol | 14 | 2.0 | THF/toluene | 650/50 |
| Example 22 | A-22 | 10-HT1 | Resin-7 | Methanol | 14 | 2.0 | THF/toluene | 650/50 |
| Example 23 | A-23 | 10-HT1 | Resin-8 | Methanol | 14 | 2.0 | THF/toluene | 650/50 |
| Example 24 | A-24 | 10-HT1 | Resin-5 | Methanol | 30 | 4.1 | THF/toluene | 650/50 |
| Example 25 | A-25 | 10-HT1 | Resin-5 | Methanol | 5 | 0.7 | THF/toluene | 650/50 |
| Comparative Example 1 | B-1 | 10-HT1 | Resin-1 | — | — | — | THF/toluene | 650/50 |
| Comparative Example 2 | B-2 | 10-HT1 | Resin-5 | Butanol | 14 | 2.0 | THF/toluene | 650/50 |
| Comparative Example 3 | B-3 | 10-HT1 | Resin-A | Methanol | 14 | 2.0 | THF/toluene | 650/50 |
| Comparative Example 4 | B-4 | 13-HT10 | Resin-1 | — | — | — | THF/toluene | 650/50 |

[Evaluation of Performance of Photosensitive Member]

(Evaluation of Electrical Characteristics)

(Measurement of Charge Potential $V_0$)

The surface potential of each of the photosensitive members (A-1) to (A-25) and the photosensitive members (B-1) to (B-4) was measured using a drum sensitivity tester (manufactured by Gen-tech Inc.) under conditions that the rotational speed of the photosensitive member was 31 rpm and the amount of a current flowing into the photosensitive member was −10 μA. The measured surface potential was considered a charge potential ($V_0$) (unit: −V). The environment in which the measurement was performed had a temperature of 35° C. and a relative humidity of 85% RH. Table 4 shows the charge potential ($V_0$). As can be seen from Table 4, as the absolute value of the charge potential ($V_0$) decreases, the charging characteristics are more excellent. It was considered that the charging characteristics are good in the case where the absolute value is 650 V or more, and are not good in the case where the absolute value is less than 650 V.

(Measurement of Potential $V_L$ after Exposure)

Each of the photosensitive members (A-1) to (A-25) and the photosensitive members (B-1) to (B-4) was charged to −600 V using a drum sensitivity tester (manufactured by Gen-tech Inc.), with the photosensitive member being rotated at a rotational speed of 31 rpm. Next, monochromatic light (wavelength: 780 nm, and exposure: 0.8 μJ/cm$^2$) was extracted from light of a halogen lamp using a band-pass filter, and the surface of the photosensitive member was illuminated with the monochromatic light. The surface potential was measured 80 msec after the end of the illumination with the monochromatic light. The measured surface potential was considered a post-exposure potential ($V_L$) (unit: −V). The environment in which the measurement was performed had a temperature of 35° C. and a relative humidity of 85% RH. Table 4 shows the post-exposure potential ($V_L$). As can be seen from Table 4, as the absolute value of the post-exposure potential ($V_L$) decreases, the sensitivity is more excellent. It was considered that the sensitivity is sufficiently practical in the case where the absolute value is 100 V or less, and is not sufficiently practical in the case where the absolute value is more than 100 V.

(Evaluation of Abrasion Resistance of Photosensitive Member)

An application liquid for charge transport layer formation was prepared. The application liquid for charge transport layer formation was formulated under conditions similar to those for the application liquid for charge transport layer formation used in production of any of the photosensitive members (A-1) to (A-25) and the photosensitive members (B-1) to (B-4). Note that the application liquid for charge transport layer formation was also subjected to a standing treatment for 48 h. The application liquid for charge transport layer formation was applied onto a polypropylene sheet (thickness: 0.3 mm) to form a coating film. The polypropylene sheet was wrapped around an aluminum pipe (diameter: 78 mm). The coating film was dried at 120° C. for 40 min. As a result, a sheet was obtained. In the sheet, a charge transport layer (thickness: 30 μm) was formed. The charge transport layer was removed from the polypropylene sheet, and was attached to a mounting card S-36 (manufactured by Taber Industries). As a result, a sample for abrasion testing was obtained.

The sample for abrasion testing was set in a rotary abrasion tester (manufactured by Toyo Seiki Seisaku-sho, Ltd.). Abrasion evaluation testing was conducted using an abrading wheel CS-10 (manufactured by Taber Industries), which was turned 1,000 revolutions under conditions that the load was 500 gf and the rotational speed was 60 rpm. An abrasion loss (mg/1000 revolutions) that is a change in the mass of a sample before and after the abrasion evaluation testing was measured. Based on the obtained abrasion loss, the abrasion resistance of each photosensitive member was evaluated. Table 4 shows the abrasion loss.

TABLE 4

| | Photosensitive member | Electrical characteristics $V_0$ [−V] | $V_L$ [−V] | Abrasion loss [mg] |
|---|---|---|---|---|
| Example 1 | A-1 | 683 | 45 | 3.5 |
| Example 2 | A-2 | 680 | 47 | 3.4 |
| Example 3 | A-3 | 675 | 51 | 3.8 |
| Example 4 | A-4 | 676 | 61 | 3.9 |
| Example 5 | A-5 | 683 | 39 | 3.5 |
| Example 6 | A-6 | 681 | 42 | 3.7 |
| Example 7 | A-7 | 680 | 45 | 3.7 |
| Example 8 | A-8 | 668 | 71 | 3.6 |
| Example 9 | A-9 | 686 | 59 | 3.3 |
| Example 10 | A-10 | 682 | 83 | 4.0 |
| Example 11 | A-11 | 680 | 44 | 3.7 |
| Example 12 | A-12 | 676 | 43 | 4.4 |
| Example 13 | A-13 | 687 | 40 | 4.9 |
| Example 14 | A-14 | 677 | 46 | 4.2 |
| Example 15 | A-15 | 676 | 45 | 3.9 |
| Example 16 | A-16 | 680 | 51 | 4.1 |
| Example 17 | A-17 | 682 | 55 | 5.5 |
| Example 18 | A-18 | 672 | 59 | 4.0 |
| Example 19 | A-19 | 683 | 49 | 4.0 |
| Example 20 | A-20 | 681 | 49 | 4.3 |
| Example 21 | A-21 | 675 | 55 | 3.9 |
| Example 22 | A-22 | 671 | 57 | 3.7 |
| Example 23 | A-23 | 683 | 59 | 3.6 |
| Example 24 | A-24 | 681 | 52 | 3.8 |
| Example 25 | A-25 | 670 | 48 | 3.9 |
| Comparative Example 1 | B-1 | 597 | 33 | 3.6 |
| Comparative Example 2 | B-2 | 680 | 132 | 4.5 |
| Comparative Example 3 | B-3 | 683 | 40 | 7.1 |
| Comparative Example 4 | B-4 | 572 | 50 | 3.7 |

As can be seen from Table 3, the application liquids for charge transport layer formation that were the application liquids for photosensitive layer formation used in the photosensitive members (A-1) to (A-25) contained one of the polyarylate resins (Resin-1) to (Resin-8) as a binder resin. The polyarylate resins (Resin-1) to (Resin-8) were a polymerization product of monomers including the monomer (1) represented by the general formula (1) and the monomer (2) represented by the general formula (2).

As shown in Table 3, the application liquid for charge transport layer formation that was an application liquid for photosensitive layer formation and was used in the photosensitive member (B-3) contained, as a binder resin, the polycarbonate resin (Resin-A) instead of a polyarylate resin.

As can be seen from Table 4, the photosensitive members (A-1) to (A-25) had more excellent abrasion resistance than that of the photosensitive member (B-3).

As shown in Table 3, the solvent of the application liquids for charge transport layer formation that were an application liquid for photosensitive layer formation and were used in the photosensitive members (A-1) to (A-25) contained a first solvent that was an alcohol having a carbon number of at least 1 and no greater than 3 and a second solvent other than the first solvent.

As shown in Table 3, the solvent of the application liquids for charge transport layer formation that were the application liquid for photosensitive layer formation and were used in the photosensitive members (B-1), (B-2), and (B-4) contained only the second solvent, but not the first solvent. Specifically, in production of the photosensitive members (B-1) and (B-4), a mixed solvent of THF and toluene was used as the solvent of the application liquid for charge transport layer formation, and in production of the photosensitive member (B-2), a mixed solvent of THF, toluene, and butanol, which is an alcohol having four carbon atoms, was used.

As can be seen from Table 4, the photosensitive members (A-1) to (A-25) had good charging characteristics, and sensitivity that is sufficiently practical. Meanwhile, the photosensitive members (B-1) and (B-4) did not have good charging characteristics. The photosensitive member (B-2) had good charging characteristics, and did not have sensitivity that is sufficiently practical. Therefore, it is considered that if the application liquid for charge transport layer formation that is an application liquid for photosensitive layer formation contains an alcohol having 3 or less carbon atoms, a photosensitive member that has excellent charging characteristics, and sensitivity that is sufficiently practical, can be formed.

It is considered that such an improvement in the charging characteristics of the photosensitive member is attributed to a reduction in the amount of aromatic dicarboxylic acid dichloride (the monomer (2)) remaining in the photosensitive layer due to the reaction thereof with the first solvent, as described above in the first embodiment. To verify this, the following testing was conducted.

(Measurement of Amount of Remaining Aromatic Dicarbonyl Dichloride) The application liquid for charge transport layer formation (standing treatment time: 48 h) used in production of the photosensitive member (A-10) of Example 10 was applied to a cut element pipe having a diameter of 242 mm and a length of 600 mm, and the resultant coating film was dried, to form a charge transport layer. The charge transport layer was removed, and dissolved in chloroform, followed by reprecipitation in hexane. The dissolution and reprecipitation were performed a total of five times to extract the binder resin from the charge transport layer. To 0.50 g of the binder resin, 14.7 g of chloroform was added so that the binder resin was dissolved in the chloroform. To the resultant resin solution, 1.47 g of a chloroform solution of 4-(4-nitrobenzyl)pyridine (concentration: 1.0 mass %) was added. The resultant mixed solution was subjected to roller milling for 1 h for color development, and thereafter, the absorbance thereof was measured at a wavelength of 450 nm using spectrophotometer ("U-3000," manufactured by Hitachi, Ltd.). The greater value of the absorbance indicates the greater amount of aromatic dicarboxylic acid dichloride remaining in the charge transport layer.

For the application liquid for charge transport layer formation (standing treatment time: 48 h) used in production of the photosensitive member (B-4) of Comparative Example 4, the amount of aromatic dicarboxylic acid dichloride remaining in the charge transport layer was measured in a manner similar to that for the photosensitive member (A-10).

For the application liquid for charge transport layer formation used in production of the photosensitive member (A-10) of Example 10, the amount of remaining aromatic dicarboxylic acid dichloride was measured (Examples 26-29) in a manner similar to that for the photosensitive member (A-10), except that the standing treatment time was changed to 72 h, 96 h, 21 h, or 12 h (Examples 26-29).

Furthermore, in order to confirm that the hole transport material and additive contained in the application liquid for charge transport layer formation have substantially no influence on the absorbance at a wavelength of 450 nm, the amount of remaining aromatic dicarboxylic acid dichloride was measured using a application liquid that did not contain a hole transport material or an additive. Specifically, 100 parts by mass of the polyarylate resin (Resin-1) (viscosity average molecular weight: 50,500) as a binder resin was added to a mixed solvent. The mixed solvent contained 650 parts by mass of tetrahydrofuran (THF) and 50 parts by mass of toluene that were a second solvent, and 14 parts by mass of methanol (MeOH) as a first solvent. These were mixed together so that the polyarylate resin (Resin-1) was dispersed in the mixed solvent, to formulate a application liquid. After the formulation, the application liquid was allowed to stand for 12 h, 24 h, 48 h, 72 h, or 96 h. The amount of remaining aromatic dicarboxylic acid dichloride was measured in a manner similar to that of Examples 10 and 26-29 and Comparative Example 4, except that these application liquids were used (Reference Examples 1-5). The results of measurement of Examples 10 and 26-29, Comparative Example 4, and Reference Examples 1-5 are shown in the following Table 5.

TABLE 5

| | | | Solvents | | | | | Static | |
|---|---|---|---|---|---|---|---|---|---|
| | | | 1st solvent | | | | | treatment | |
| | | Binder | | | Content | 2nd solvent | | time | 450 nm |
| | HTM | resin | Type | Parts | [%] | Type | Parts | [h] | absorbance |
| Example 10 | 13-HT10 | Resin-1 | Methanol | 14 | 2.0 | THF/toluene | 650/50 | 48 | 0.085 |
| Comparative Example 4 | 13-HT10 | Resin-1 | — | — | — | THF/toluene | 650/50 | 48 | 0.533 |
| Example 26 | 13-HT10 | Resin-1 | Methanol | 14 | 2.0 | THF/toluene | 650/50 | 72 | 0.034 |
| Example 27 | 13-HT10 | Resin-1 | Methanol | 14 | 2.0 | THF/toluene | 650/50 | 96 | 0.020 |
| Example 28 | 13-HT10 | Resin-1 | Methanol | 14 | 2.0 | THF/toluene | 650/50 | 21 | 0.099 |
| Example 29 | 13-HT10 | Resin-1 | Methanol | 14 | 2.0 | THF/toluene | 650/50 | 12 | 0.155 |
| Reference Example 1 | — | Resin-1 | Methanol | 14 | 2.0 | THF/toluene | 650/50 | 48 | 0.090 |
| Reference Example 2 | — | Resin-1 | Methanol | 14 | 2.0 | THF/toluene | 650/50 | 72 | 0.025 |
| Reference Example 3 | — | Resin-1 | Methanol | 14 | 2.0 | THF/toluene | 650/50 | 96 | 0.005 |
| Reference Example 4 | — | Resin-1 | Methanol | 14 | 2.0 | THF/toluene | 650/50 | 24 | 0.120 |
| Reference Example 5 | — | Resin-1 | Methanol | 14 | 2.0 | THF/toluene | 650/50 | 12 | 0.148 |

As can be seen from Table 5, the application liquid for charge transport layer formation used in production of the photosensitive member of Example 10 was able to form a charge transport layer containing a smaller amount of remaining aromatic dicarboxylic acid dichloride than that of the application liquid for charge transport layer formation used in production of the photosensitive member of Comparative Example 4.

As can be seen from comparison between Examples 10 and 26-29, the amount of aromatic dicarboxylic acid dichloride remaining in the charge transport layer decreases with an increase in the standing treatment time of the application liquid for charge transport layer formation. This may be because the lower alcohol and aromatic dicarboxylic acid dichloride react with each other for a period of time between the time that the application liquid for charge transport layer formation is formulated and the time that the application liquid for charge transport layer formation is applied.

Furthermore, as can be seen from comparison between Examples 10 and 26-29 and Reference Examples 1-5, the presence or absence of the hole transport material and the additive had substantially no influence on the absorbance at a wavelength of 450 nm. Therefore, it is considered that the absorbance at a wavelength of 450 nm accurately reflected the amount of remaining aromatic dicarboxylic acid dichloride.

What is claimed is:

1. A method for producing an electrophotographic photosensitive member including an electrically conductive substrate and a photosensitive layer, the method comprising:

applying an application liquid for photosensitive layer formation containing a solvent, a binder resin, and a hole transport material directly or indirectly onto the electrically conductive substrate, and removing a portion of the solvent, to form the photosensitive layer, wherein the solvent contains a first solvent that is an alcohol having a carbon number of at least 1 and no greater than 3, and a second solvent other than the first solvent, and the binder resin includes a polyarylate resin that is a polymerization product of monomers including a first monomer and a second monomer, the first monomer including either of a compound represented by general formula (1-1) and a compound represented by general formula (1-2), the second monomer including at least one of a compound represented by chemical formula (2-1-1) and a compound represented by chemical formula (2-1-2), (1-1)

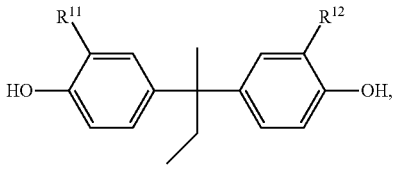

where in the general formula (1-1), $R^{11}$ and $R^{12}$ each represent, independently of one another, a hydrogen atom or an alkyl group having a carbon number of at least 1 and no greater than 4, (1-2)

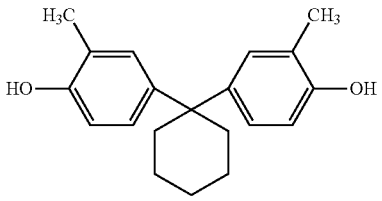

-continued (2-1-1)

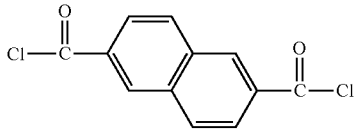

(2-1-2)

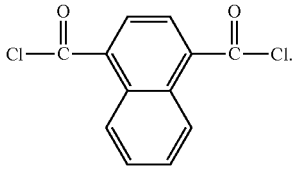

2. The method for producing an electrophotographic photosensitive member according to claim 1, wherein the second solvent contains at least one of methylene chloride, chloroform, tetrahydrofuran, and 1,3-dioxolane.

3. The method for producing an electrophotographic photosensitive member according to claim 1, wherein the second monomer includes the compound represented by chemical formula (2-1-2).

4. The method for producing an electrophotographic photosensitive member according to claim 1, wherein the binder resin includes at least one of polyarylate resins represented by chemical formulas (Resin-1), (Resin-2), (Resin-3), and (Resin 5),

5. The method for producing an electrophotographic photosensitive member according to claim 1, wherein the content portion of the first solvent in the solvent is at least 0.5 mass % and no greater than 5.0 mass %.

6. The method for producing an electrophotographic photosensitive member according to claim 1, wherein the first solvent contains at least one of methanol and 2-propanol.

7. The method for producing an electrophotographic photosensitive member according to claim 1, wherein the hole transport material contains at least one of compounds represented by general formulas (10), (11), (12), and (13), (10)

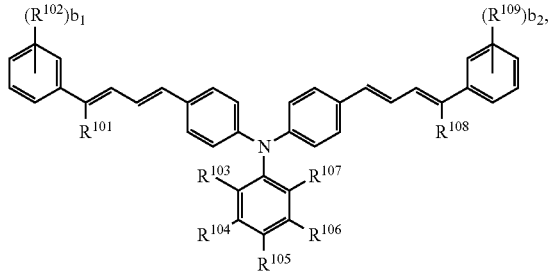

in the general formula (10), $R^{101}$, $R^{103}$, $R^{104}$, $R^{105}$, $R^{106}$, $R^{107}$, and $R^{108}$ each independently represent a hydrogen atom, an alkyl (Resin-1)

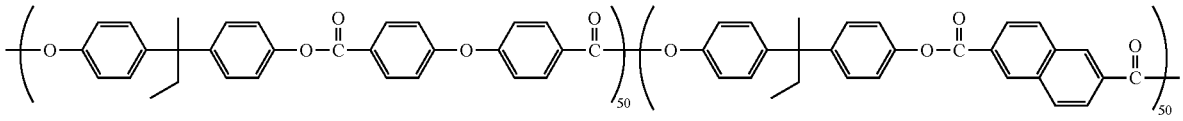

(Resin-2)

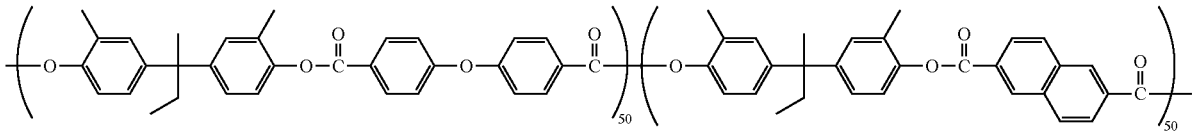

(Resin-3)

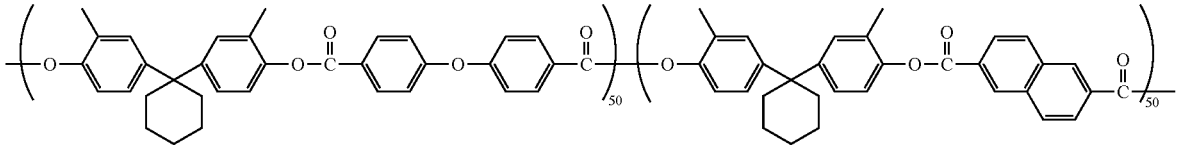

(Resin-5)

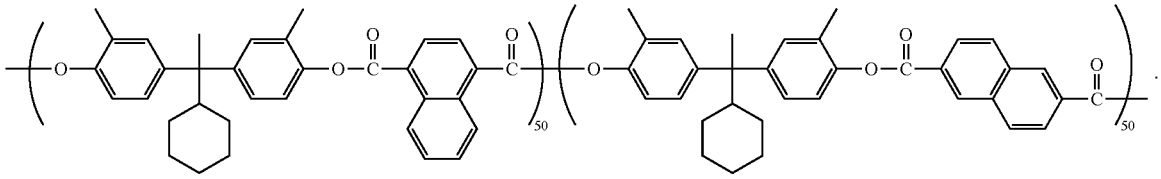

group having a carbon number of at least 1 and no greater than 8, a phenyl group optionally substituted with an alkyl group having a carbon number of at least 1 and no greater than 8, or an alkoxy group having a carbon number of at least 1 and no greater than 8, two adjacent ones of $R^{103}$, $R^{104}$, $R^{105}$, $R^{106}$, and $R^{107}$ optionally taken together represent a cycloalkane having a carbon number of at least 5 and no greater than 7, $R^{102}$ and $R^{109}$ each independently represent an alkyl group having a carbon number of at least 1 and no greater than 8, a phenyl group, or an alkoxy group having a carbon number of at least 1 and no greater than 8, and $b_1$ and $b_2$ each independently represent an integer of at least 0 and no greater than 5, (12)

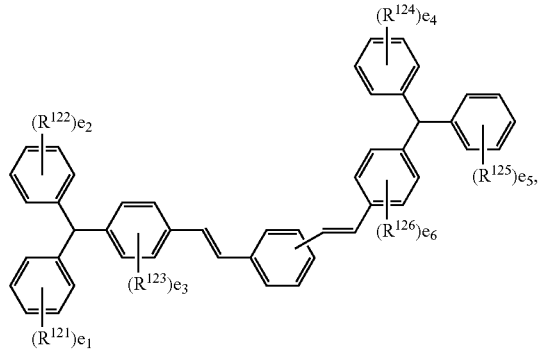

in the general formula (12), $R^{121}$, $R^{122}$, $R^{123}$, $R^{124}$, $R^{125}$, and $R^{126}$ each independently represent an alkyl group having a carbon number of at least 1 and no greater than 8, a phenyl group, or an alkoxy group having a carbon number of at least 1 and no greater than 8, (11)

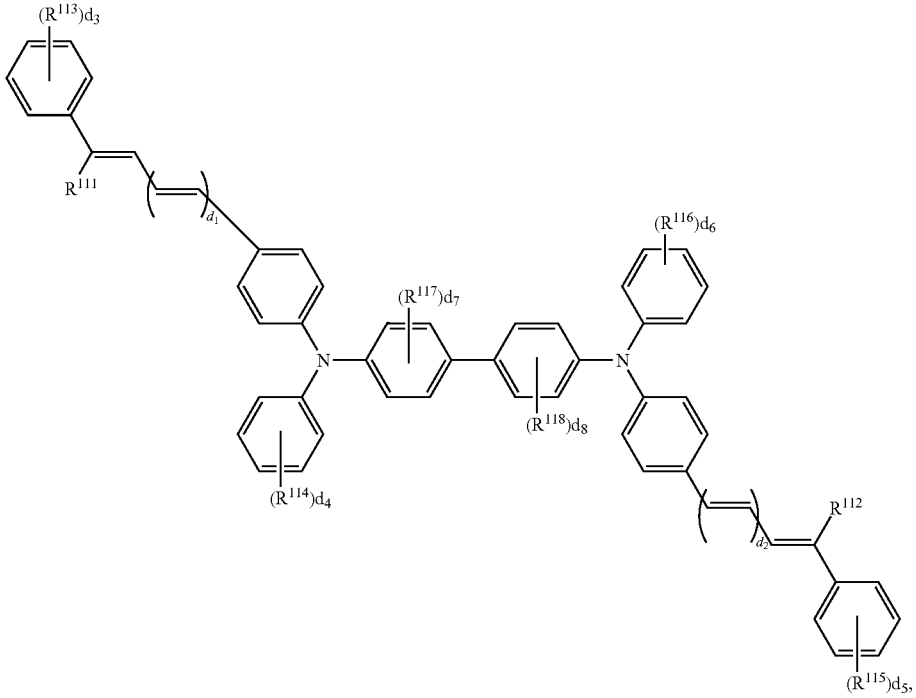

in the general formula (11), $R^{111}$ and $R^{112}$ each independently represent a hydrogen atom, an alkyl group having a carbon number of at least 1 and no greater than 8, or a phenyl group, $R^{113}$, $R^{114}$, $R^{115}$, $R^{116}$, $R^{117}$, and $R^{118}$ each independently represent an alkyl group having a carbon number of at least 1 and no greater than 8 or a phenyl group, $d_1$ and $d_2$ each independently represent 0 or 1, $d_3$, $d_4$, $d_5$, and $d_6$ each independently represent an integer of at least 0 and no greater than 5, and $d_7$ and $d_8$ each independently represent an integer of at least 0 and no greater than 4, $e_1$, $e_2$, $e_4$, and $e_5$ each independently represent an integer of at least 0 and no greater than 5, and $e_3$ and $e_6$ each independently represent an integer of at least 0 and no greater than 4, (13)

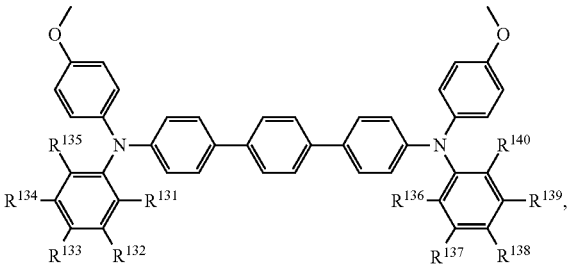

in the general formula (13), $R^{131}$, $R^{132}$, $R^{133}$, $R^{134}$, $R^{135}$, $R^{136}$, $R^{137}$, $R^{138}$, $R^{139}$, and $R^{140}$ each independently represent a hydrogen atom or a methyl group.

8. The method for producing an electrophotographic photosensitive member according to claim 7, wherein in the general formula (10), $R^{101}$ and $R^{108}$ represent a phenyl group substituted with an alkyl group having a carbon number of at least 1 and no greater than 8, or a hydrogen atom, $R^{102}$ and $R^{109}$ represent an alkyl group having a carbon number of at least 1 and no greater than 8, $R^{103}$, $R^{104}$, $R^{105}$, $R^{106}$, and $R^{107}$ each independently represent a hydrogen atom, an alkyl group having a carbon number of at least 1 and no greater than 8, or an alkoxy group having a carbon number of at least 1 and no greater than 8, and two adjacent ones of $R^{103}$, $R^{104}$, $R^{105}$, $R^{106}$, and $R^{107}$ are optionally taken together to form a cycloalkane having a carbon number of at least 5 and no greater than 7, and $b_1$ and $b_2$ each independently represent 0 or 1, in the general formula (11), $R^{111}$ and $R^{112}$ each represent a hydrogen atom or a phenyl group, $R^{113}$, $R^{114}$, $R^{115}$, $R^{116}$, $R^{117}$, and $R^{118}$ each independently represent a methyl group or an ethyl group, $d_1$ and $d_2$ each independently represent 0 or 1, $d_3$, $d_4$, $d_5$, and $d_6$ each independently represent an integer of at least 0 and no greater than 2, and $d_7$ and $d_8$ each represent 0, in the general formula (12), $R^{121}$, $R^{122}$, $R^{123}$, $R^{124}$, $R^{125}$, and $R^{126}$ each independently represent an alkyl group having a carbon number of at least 1 and no greater than 8, $e_1$, $e_2$, $e_4$, and $e_5$ each independently represent an integer of at least 0 and no greater than 2, and $e_3$ and $e_6$ represent 0, and in the general formula (13), $R^{131}$, $R^{132}$, $R^{133}$, $R^{134}$, $R^{135}$, $R^{136}$, $R^{137}$, $R^{138}$, $R^{139}$, and $R^{140}$ each represent a hydrogen atom.

9. The method for producing an electrophotographic photosensitive member according to claim 8, wherein the hole transport material contains at least one of compounds represented by chemical formulas (10-HT1), (10-HT2), (10-HT3), (10-HT4), (11-HT5), (11-HT6), (11-HT7), (12-HT8), (12-HT9), and (13-HT10), (10-HT1)

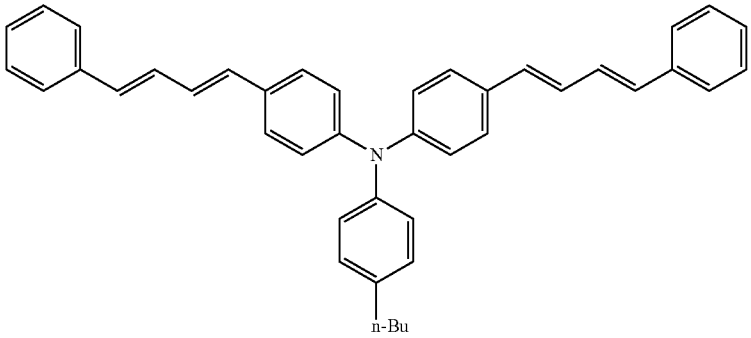

(10-HT2)

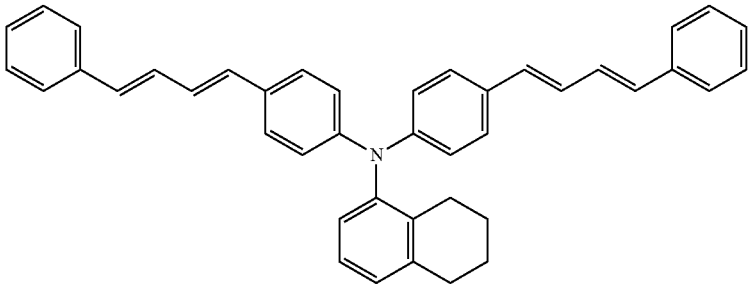

(10-HT3)

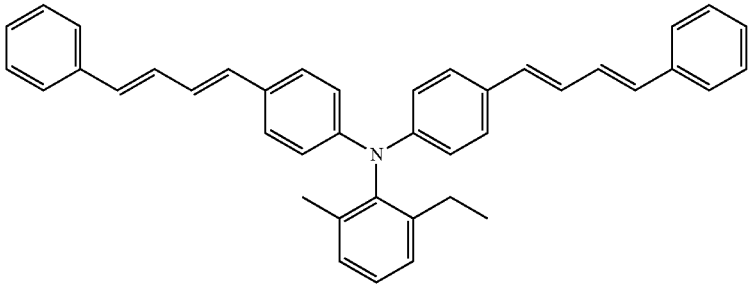

-continued
(10-HT4)
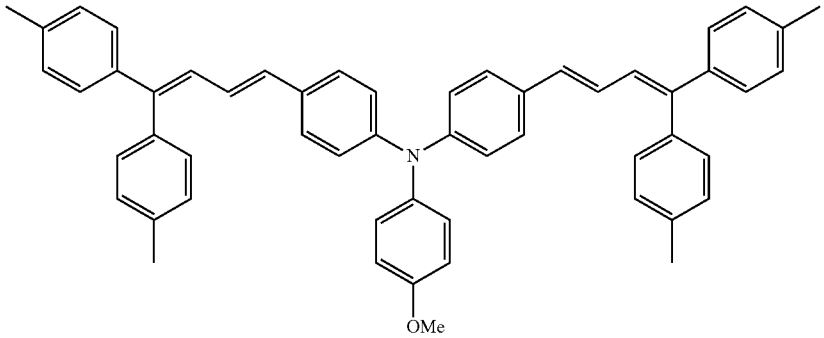
(11-HT5)
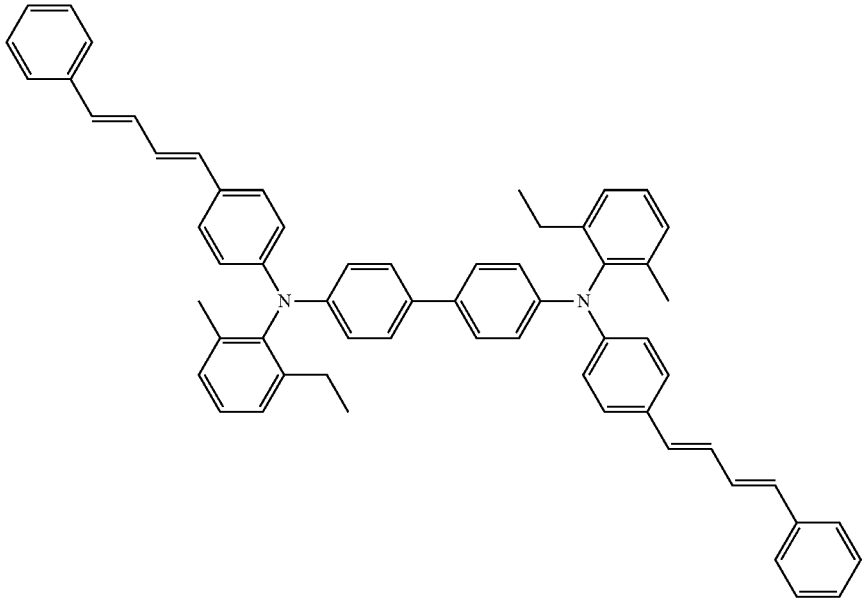
(11-HT6)
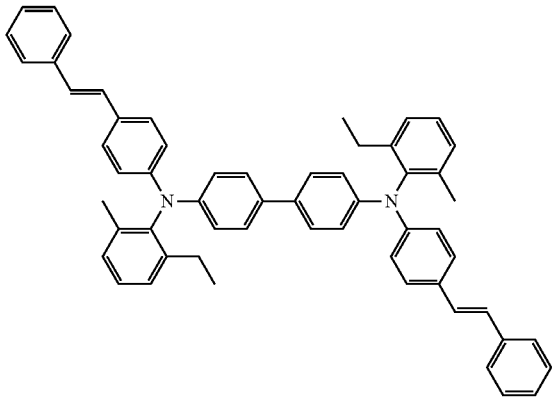
(11-HT7)
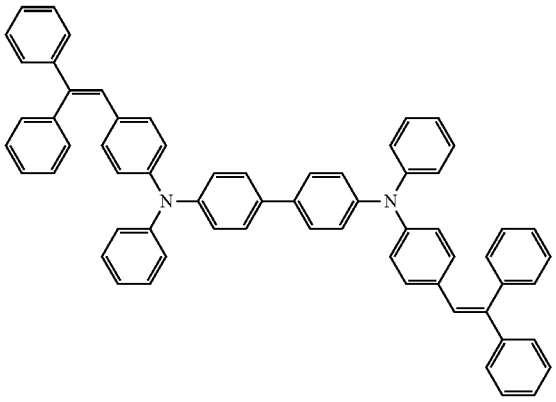

-continued (12-HT8)

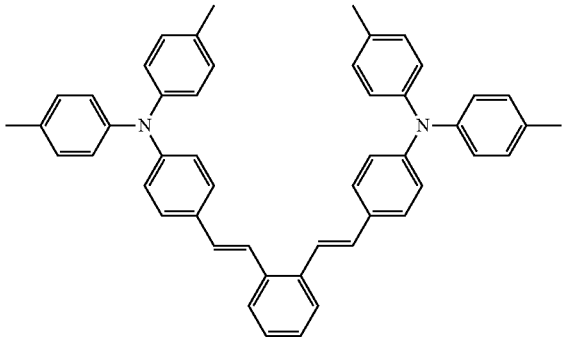

(12-HT9)

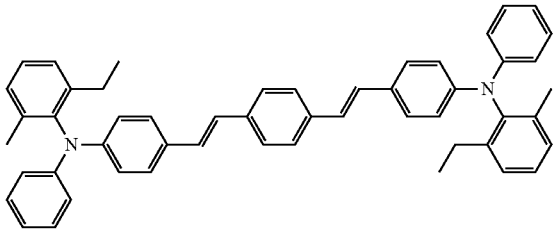

(13-HT10)

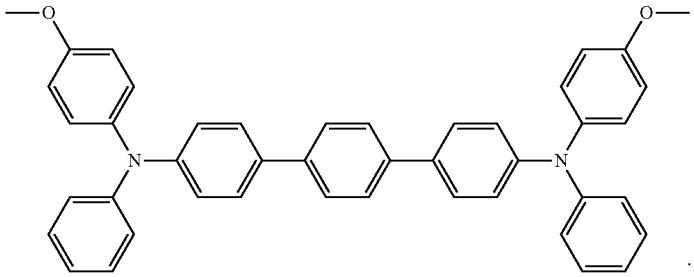

10. The method for producing an electrophotographic photosensitive member according to claim 9, wherein the hole transport material contains at least one of the compound represented by the chemical formulas (10-HT2), (11-HT5), and (12-HT9).

11. The method for producing an electrophotographic photosensitive member according to claim 1, further comprising:

preparing the application liquid for photosensitive layer formation; and leaving the application liquid for photosensitive layer formation after the preparing to stand still until the applying, wherein the application liquid for photosensitive layer formation is left to stand for 10 hours or more and 120 hours or less.

* * * * *